United States Patent [19]

Kurtin et al.

[11] 4,237,343

[45] Dec. 2, 1980

[54] DIGITAL DELAY/AMBIENCE PROCESSOR

[76] Inventors: Stephen L. Kurtin, 3835 Kingswood Rd., Sherman Oaks, Calif. 91403; Edward C. Kelm, 1136 Wellington Ave., Pasadena, Calif. 91103

[21] Appl. No.: 876,540

[22] Filed: Feb. 9, 1978

[51] Int. Cl.[3] ..... H04R 5/00; H04H 7/00

[52] U.S. Cl. ..... 179/1 J

[58] Field of Search ..... 179/1 J, 15.55 T; 340/347 AD; 235/92 CC, 91 PR; 328/62, 187, 188

[56] References Cited

U.S. PATENT DOCUMENTS

| | | | |
|---|---|---|---|
| 3,737,897 | 6/1973 | Cuthbert et al. | 340/347 AD |
| 3,934,094 | 1/1976 | Kobayashi et al. | 179/15.55 T |
| 3,981,005 | 9/1976 | Takayama et al. | 340/347 AD |
| 4,027,101 | 5/1977 | De Frietas et al. | 179/1 J |
| 4,121,058 | 10/1978 | Jusko et al. | 179/15.55 T |

FOREIGN PATENT DOCUMENTS

| | | | |
|---|---|---|---|
| 1456800 | 11/1976 | United Kingdom | 179/1.5 J |

*Primary Examiner*—Malcolm A. Morrison
*Assistant Examiner*—E. S. Kemeny
*Attorney, Agent, or Firm*—Martin R. Horn

[57] ABSTRACT

A processor for audio program material which synthesizes simulated reflection and reverberation signals for use in creating the illusion of a specific modeled listening environment. A preferred embodiment of the processor accepts stereophonic audio signals and simulates the multiple reflections of an acoustically modeled environment by recirculating the signals through a pair of digital signal delays which have different delay times. The analog input signals are sampled and converted to digital form by first attenuating the signals with a digitally controlled step attenuator and then encoding the amplitude of the attenuated signal using a ramp comparison technique. The encoded amplitude signals, and a code representative of the attenuator position, are stored in a random access memory and are retrieved after the desired delay. The retrieved digital data are converted back to analog signals by reversing the encoding process, using the same ramp voltage generator. A stack comprised of a counter and two registers connected in a loop generates three addresses during each sample period for use in writing in new data and retrieving previously stored data.

26 Claims, 12 Drawing Figures

RUN
206
205
WE
207
D
Q
F/F
CLK
Q̄
OSC
CE
CE
ACNT
219
220
PRUN
WRT
RUN
218
LOAD
208
LOAD
215
WAIT
E
STSM
CLR
CLK
IA
IB
IC
ID
QC
QD
XFR
BINARY COUNTER
CO
204
OSC
+5V
QA
QB
QC
QD
XFR
E
BINARY COUNTER
CO
CLK
IA
IB
IC
ID
209
OSC
+5V
COUNT
LOAD

+12V
607
605
608
609
+5V
614
613
606
604
-12V
610
-5V
601
603
602
RAMP
611
612
RUN

MASTER TIMING DIAGRAM

BCD DECADE CNTR
BIN. CNTR
TO IB OF COUNTER 501
DECODER
F/F
BIN. CNTR
UP/DN CNTR
STOP
WRT
LOAD
A2
A13
TO QA OF COUNTER 514
QA-QN BINARY COUNTER
QA-QL BINARY REGSTR
S/R
A0-A13
QC-QN
COUNT
+5V

LOUT
36
FROM
HP FILTER 18
20
21
34
910
911
0db 10db 20db 30db
BINARY COUNTER
SWITCH
IA IB OUT
LDLY
22
903
QB
S/R
CLK IN
L9
OSC
902
L8
L0-L7
901
BINARY
COUNTER
CO E1 E2 XFR CLK
L10
L0-L10
908
909
SAH
905
904
906
907
RAMP
PRUN
HOSC
RUN
STSM

1004
STEREO AUDIO PROGRAM SOURCE
1005
STEREO PREAMP
1006
STEREO AMP
L INPUT
1007
L OUT
1010
DIGITAL DELAY AMBIENCE PROCESSOR
STEREO AMP
R INPUT
R OUT
1009
1008
1001
1003
1002

DIGITAL DELAY/AMBIENCE PROCESSOR

BACKGROUND OF THE INVENTION

1. Field of the Invention

This invention relates generally to the generation of time delayed audio signals, and more particularly to the generation of such signals for use in simulating auditorium ambience, including reverberations.

2. Prior Art

It is universally recognized that, irrespective of the quality of reproduction, music played through a conventional stereophonic or multi-channel high fidelity reproducing system in a small room, such as a residential living room, will not sound the same as does live music in an auditorium. This difference is due in no small part to the difference in the reverberation characteristics of the two environments. In a living room, the walls are close together so that reflections are close together temporally, and are rapidly damped out due to absorption by the walls and furnishings. In an auditorium or hall, on the other hand, the transit times of the reflections are substantially longer, and each sound generally persists for a longer time.

It has been known in the prior art to simulate auditorium reverberations in a small room by placing extra loudspeakers behind the listeners and feeding a reduced volume delayed signal thereto. It has also been known to recirculate the reduced volume signal through the delay means repeatedly to simulate multiple reflections. These prior art attempts to reproduce the ambience of an auditorium in a small listening environment have generally suffered from a number of shortcomings which have been overcome by the present invention. Among the shortcomings of the prior art approaches to auditorium ambience simulation which have been overcome by the present inventions are inappropriate acoustic modeling, insufficient control flexibility, poor signal quality, inadequate dynamic range, and poor signal to noise ratio.

BRIEF SUMMARY OF THE INVENTION

The sound of live music radiates from its source in all directions. In an auditorium or hall much of what reaches a listener is sound that has been reflected off the various surfaces in the room and these reflections arrive at the listener at various times depending on the distances travelled. In general, as time passes after a particular sound is generated, the related echo density increases. The amplitudes of the echoes from a given initial sound decrease with time with a decay rate dependent on the character of the reflective surfaces and the size of the auditorium. To a large extent it is the timing and relative amplitudes of these echoes that give an auditorium its acoustic character or "ambience".

The Digital Delay Ambience Processor herein disclosed, in one of its aspects, accepts signals provided by conventional multi-channel sound systems, such as a stereophonic system, and processes them to provide echo signals which can be played through auxiliary loudspeakers to cause the listener to perceive the sound as if it were being played in a listener-selected auditorium of a specific size and liveness even though the program is, in fact, being played in a smaller room. The auxiliary loudspeakers referred to above, which project the processed signals, are supplementary to the loudspeakers used in the conventional sound system with which the processor is being used. The primary loudspeakers of the conventional system are preferably placed generally in front of the listeners as is normal, while the auxiliary loudspeakers which project the simulated echo/reverberation components of the total sound are preferably placed generally behind or alongside the listeners.

The acoustic properties of the listening environment are not changed by the present invention; i.e., the fast reflections which are characteristic of a small room are not removed or reduced. However, it has been found that when echoes/reverberations simulating the multiple reflections of a larger room or auditorium are properly projected, the listener perceives an acoustic space dominated such signals, and the illusion is that one is listening in the larger room.

In a presently preferred embodiment of the invention, two channels of program material from a standard stereophonic reproducing system are processed to provide two output signals representing the reflected sounds or reverberations of a phantom auditorium or room whose "apparent" size and "liveness" characteristics have been chosen by the listener. These signals may be amplified by conventional means and projected by the auxiliary loudspeakers.

The input signal to each of the two channels of the Processor is filtered and mixed with a predetermined fraction of the signal at the opposite channel input, as well as with signals fed back from both channel outputs, so as to form a mixed signal with carefully controlled simulated echoes. The instantaneous amplitudes of the mixed signal in each channel are sampled at a rate of about 16,000 samples per second, and each sample is converted into digital form and stored sequentially in a random access memory. After a delay, which may be between 1 and 100 milliseconds, the samples are read out of the memory and reconverted to analog form.

Three groups of memory addresses are generated during each sample period, one being a storage address for the data being sampled, and two being addresses of previously stored data. The addresses are generated in a "stack" comprised of one binary counter and two registers connected in a loop so that the count attained by the counter during each sample period circulates through the stack in subsequent sample periods.

Reconverted signals are filtered to remove the sampling irregularities, and a portion of the opposite channel reconverted signal is added to each, to form the Processor output signals. As mentioned previously, a portion of each output signal is fed back to the inputs of the processor for the purpose of simulating reverberance. If, for example, the delay between writing a particular instantaneous amplitude into the memory and the reading out of that particular amplitude from the memory is 25 milliseconds, a portion of the fed back signal will, 25 milliseconds after having been fed back to the input, appear at the output again, simulating a sound wave that has travelled about 27 feet further than the original sound. It is also reduced in amplitude as an actual reflection would be.

One of the novel aspects of the present invention is the use of only two delay means to create a large number of simulated reflections of each sound. The first of the simulated reflections appears some adjustable time after the initial sound, followed by other reflections spaced closer and closer together as time proceeds. This is accomplished by using different delay times in the two channels. Since the Processor output resulting from a momentary input sound signal is a series of signals which have passed through each of the delay means various numbers of times (because of cross coupling between the channels), making the least common multiple of the delay times relatively high results in few coinciding echoes.

In the presently preferred embodiment of the invention described herein the ratio of the delay times in the two channels is maintained at 0.625, (or 5 to 8), but satisfactory results can be obtained over a range of about 0.55 to about 0.75, preferably avoiding those ratios which are integral factors of low integers; e.g., 0.667.

The absolute lengths of the delays used are related to the size of the auditorium being simulated, longer delay times being used when simulating a larger auditorium. The level of the fed back signals is related to the "liveness" of the auditorium, the lower the level of the fed back signals, the faster will the echoes of each individual sound die out. By adjusting these two variables, the delay times and the amplitudes of the feedback signals, a wide variety of listening environments can be simulated.

A unique means of digitizing and reconstructing the samples of the signal is presented which involves sampling the amplitude of the signal to be digitized, setting a step attenuator to a level which reduces the sample level to within the range of an A/D converter, comparing the attenuated sample amplitude with the amplitude of a linear ramp voltage, and encoding the time of coincidence between the sample voltage and the ramp voltage. Reconstruction of the sample voltage to analog form essentially reverses the encoding process. The same ramp voltage as used in the encoding step is sampled at the time encoded in the digitizing step, and the resulting signal "deattenuated" by the same ratio as the original attenuation.

The encoding procedure results in a binary coded digital word of 10 bits which represents the amplitude of the original signal. Eight of the bits represent the amplitude of the sample on a −5 volt to +5 volt scale, and the other two bits represent the setting of a step attenuator which is automatically set prior to digitizing so that the signal presented to the digitizer is within the range of + or −5 volts.

BRIEF DESCRIPTION OF THE DRAWINGS

FIG. 8 is a circuit diagram of the memory and associated data registers.

DETAILED DESCRIPTION OF THE PREFERRED EMBODIMENT

Figure 1:
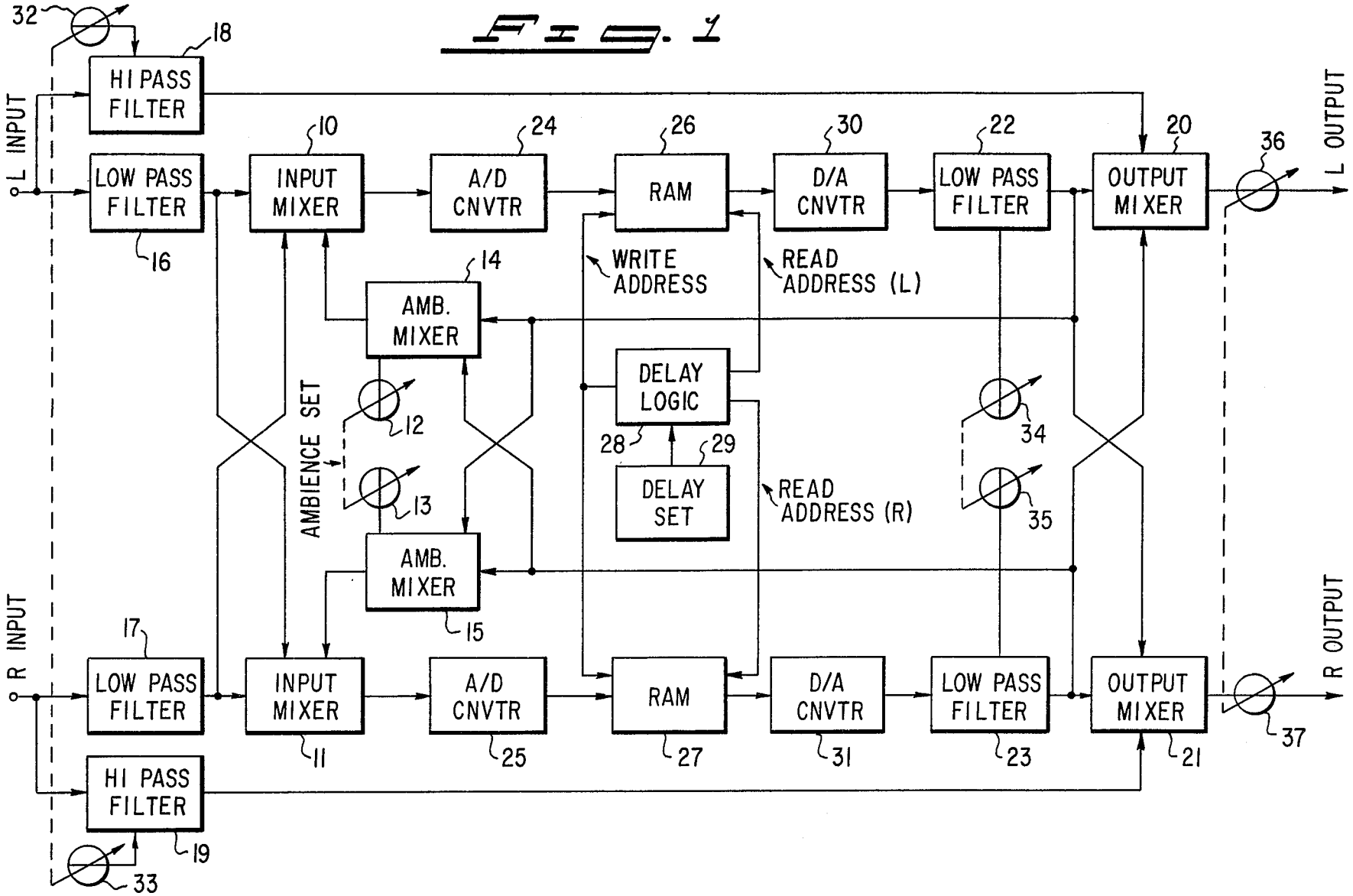
FIG. 1 is a block diagram of the invented Digital Delay Ambience Processor.

The simulated reverberation signals generated by the presently preferred embodiment of the invention are synthesized in two processor channels from a standard two channel stereo signal. The two processor channels are similar and each includes a means for delaying the signal to simulate the additional transit time of a reflected sound. A portion of the delayed output of each channel is fed back to its own channel input and also to the input of the opposite channel, with the result that a signal representing a single sound entering one of the channels will be fed through each of the delays a large number of times, and in various combinations, as it decays in amplitude. Each time it is fed through one of the delays and appears at the output of the processor it simulates a later reflection (or echo). The first few simulated reflections of an individual sound are discrete signals but as time passes the echoes become so closely spaced that they cannot be separately discerned. The actual magnitudes of the delay times used, as will be discussed below, relate to the size of the auditorium being simulated, but, in order to provide the desired high echo density using but two delay means, the delay in one channel is made different from the other. Satisfactory echo density in the simulated reverberation signals can be achieved with a ratio of one of the delay times to the other of between about 0.55 and about 0.75, but in the presently preferred embodiment of the invention described herein the ratio of the two delays is 0.625 or $\frac{5}{8}$.

It is preferred that the two delay times be relatively incommensurate, that is, have a relatively high lowest common multiple, for the reason that there will be fewer echoes which coincide in time if such is the case. This can be illustrated by assuming that the delays are in the ratio of 0.5 with the delay times in the two channels (called L and R) being 10 and 20 milliseconds respectively. The first simulated reflection signal will appear at the output of the processor 10 milliseconds after a signal is fed to the input of the L channel of the processor. A portion of the L channel input is fed to the R channel input (as will be described later) so that a second simulated reflection signal will appear at the output of the R channel 20 milliseconds after the initial signal input. There will also be a simulated reflection signal 20 milliseconds after the start due to a signal fed back through the L channel delay a second time. It can easily be seen that a ratio of 0.5 between the delay times in the two channels will lead to many such coincident simulated reflection signals.

In contrast, if the ratio is 0.625 (say delay times of 10 and 16 milliseconds respectively), the first time two simulated echo signals will be coincident will be 80 milliseconds after the initial signal is introduced, and there will consequently be many fewer coincident echoes.

While during the course of an actual program, sounds are being continuously generated, and mixed with echoes of previous sounds, so as to form extremely complex acoustic waveforms, it is helpful in visualizing the operation of the Processor to focus on a single sound and its reflections as simulated by the present invention. As actual program is merely the summation of a large number of such sounds and consideration of a signal resulting from single sound will illustrate the principles of the invention with the least complexity.

In the preferred embodiment described, the ratio of the two time delays is always 0.625, or $\frac{5}{8}$, but the absolute values are adjustable to allow simulation of various sized rooms or auditoriums. The longer of the two delays may be set to any desired value between 1 and 100 milliseconds and the delay in the second channel will always be $\frac{5}{8}$ of the delay set in the first channel. This range has been found adequate to simulate most desired conditions.

OVERVIEW OF THE SYSTEM

Figure 10:
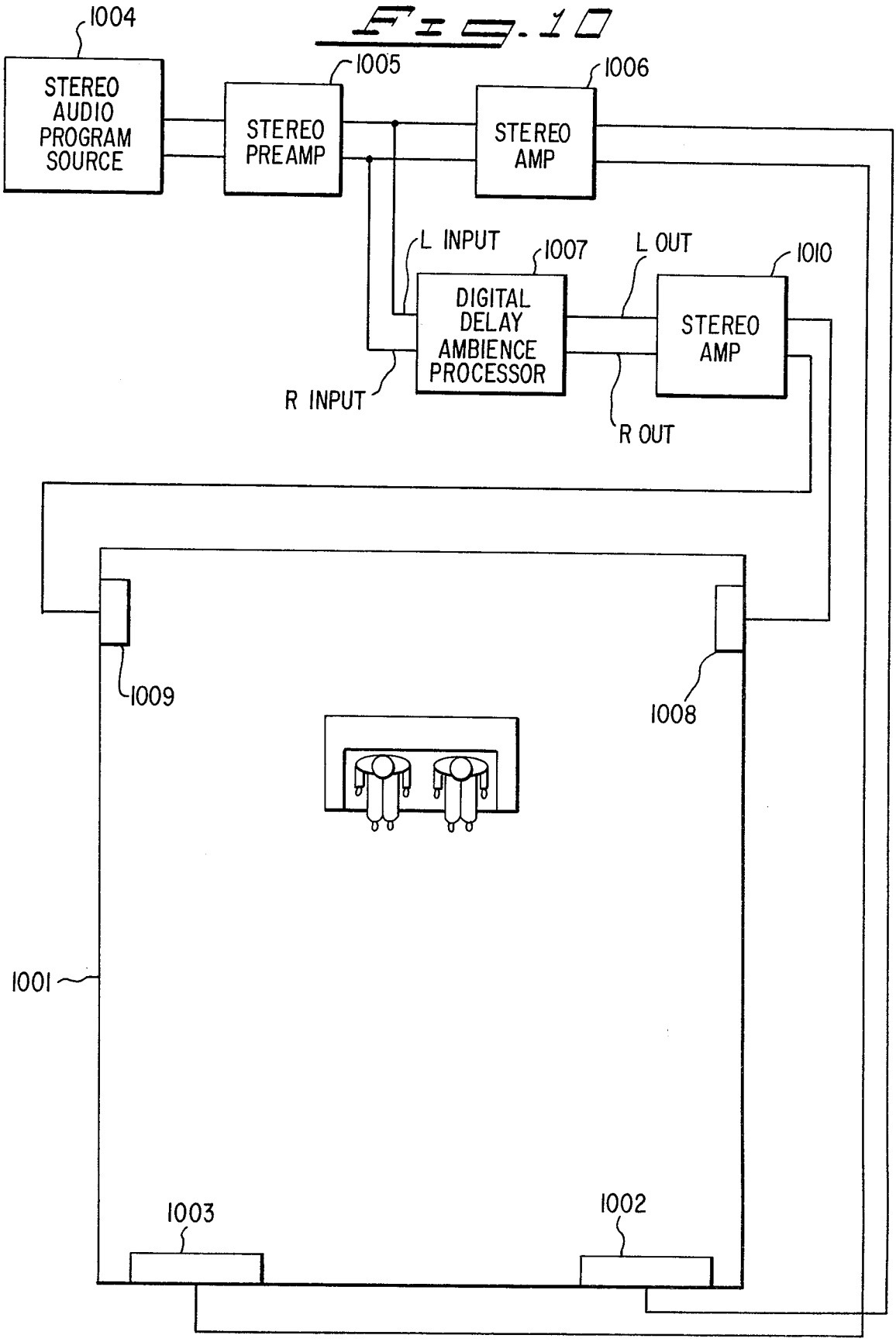
FIG. 10 is a total system block diagram for a typical system using the present invention and includes a plan view of one possible listening arrangement.

An overview of the organization of the presently preferred embodiment of the invention can be had by referring to the block diagram of FIG. 1. FIG. 10, which shows a typical interconnection of the Processor with a stereo sound system, may also be referred to.

A pair of incoming stereo signals from a conventional stereophonic sound system are coupled to the two processor channels, L and R, and are initially filtered to separate the low and high frequency components. It has been found that it is not important to the simulation of auditorium ambience that echoes be provided for program components higher than about 6 KHz, and consequently the signals in each processing channel are split into low and high frequency components by filters 16 and 18 in the L channel, and 17 and 19 in the R channel. By making the cut off frequency of the high pass filters 18 and 19 about 7.5 KHz, audible peaks in the frequency response near the 6 KHz crossover frequency are avoided. The outputs of high pass filters 18 and 19 are coupled directly to output mixers 20 and 21 without being delayed, while the low frequency components are processed to create the simulated echo signals as will be described in more detail below. The low pass filters 16 and 17 in the presently preferred embodiment of the invention are complex sharp cut off filters which effectively remove all program components above 6 KHz.

The low frequency components from the low pass filters are fed into input mixers 10 and 11 where signals from the opposite channel input and from the Processor output are added to achieve the desired reverberation characteristic. The L and R input signals are cross coupled between channels such that input mixers 10 and 11 each mix 50% of the opposite channel input with its respective direct input. A third "ambience" signal is also mixed with the input signals in mixers 10 and 11 as indicated in FIG. 1. The amplitudes of the ambience signals are adjustable and are set by attenuators 12 and 13. Adjustment of attenuators 12 and 13 affects the "liveness" of the simulated listening environment. The "ambience" signals are a mixture of the delayed outputs of the two Processor channels, and each contains 33% of the delayed signal from its own channel and 40% of an inverted signal from the cross channel. This latter mixing is done in ambience mixers 14 and 15. The variable attenuators 12 and 13 allow from 0 to 100% of the ambience mixtures to be mixed with the input signals in input mixers 10 and 11. Reducing the relative amplitude of the ambience signals fed back from the outputs increases the decay rate of the echoes and reduces the apparent "liveness" of the simulated auditorium.

The filtered and mixed signals in both channels are sampled at an approximate 16 KHz rate, and the instantaneous values digitilzed to a 10 bit code in A/D converters 24 and 25. These values are stored in random access memories 26 and 27 for future retrieval. After a period of time determined by the delay logic 28, the data are retrieved from RAMs 26 and 27 and reconverted to analog signals.

The delay logic 28, which is controlled by the delay set 29, will retrieve the data from RAM 27 after any desired delay set. In the presently preferred embodiment of the invention described herein, the delay in retrieving data from RAM 27, as set by delay set 29, can assume any desired value between 1 millisecond and 100 milliseconds, and the delay in retrieving data from RAM 26 will be $\frac{5}{8}$ of the set value. Consequently, if the logic is set to retrieve data from RAM 27 40 milliseconds after it is inserted, data inserted in RAM 26 will be retrieved after 25 milliseconds. The apparent size of the phantom auditorium being simulated is determined by the amount of delay time set.

The retrieved data are reconverted to analog signals by D/A converters 30 and 31 and filtered by low pass filters 22 and 23. A final mixing of the signals in output mixers 20 and 21 results in a pair of output signals which can be amplified and fed to auxiliary loudspeakers preferably positioned generally behind or alongside the listener. The output of these loudspeakers supplements sound from the direct stereo loudspeakers and their use with appropriate signals from the Digital Delay Ambience Processor can simulate an auditorium listening environment of any of a wide range of desired sizes and livenesses. The mixing ratio of the output mixers which has been found to yield the most satisfactory sound is 1 to $\frac{1}{3}$, that is, output mixer 20 mixes 100% of the output of low pass filter 22 with one-third the output of low pass filter 23. In discussing the various mixing ratios herein, it should be noted that system gain is maintained at essentially unity throughout, that is, a signal at some level, say 1 volt, entering at the L input will appear at the output of low pass filter 22 at a level of essentially 1 volt albeit delayed and mixed with other signals. It is not essential that this be true, but making the assumption that the signal levels are constant simplifies the explanation.

Controls 32 and 33, which are ganged, adjust the level of the undelayed high frequency signal supplied to the output mixers. A range of zero signal to about 6 db above the input level has been found to be a useful range. It has also been found to be useful to provide for some adjustment in the frequency response to the low frequency portion of the system so as to allow for compensating for speaker and/or room deficiencies, or for achieving a slight rise in the bass response such as often encountered in concert halls. A bass boost or cut of 10 dB relative to the mid frequencies has been found to be a satisfactory range, and controls 34 and 35 are provided for this purpose. Level controls 36 and 37 set the final signal level as fed to the L and R channel auxilliary speakers, respectively.

The detailed operation of the present invention is described below in several sections. The first sections deal with the generation of the various logical control functions, and the later with the application of these functions to process the program material.

LOGIC CONTROL

The digitizing, delay, and reconstituting of the signals in the ambience processor is accomplished in accordance with a number of logical signals which are generated in the logic, memory, and delay control portions of the processor. These signals are repeatedly referred to herein in explaining the operation of the processor and it is convenient to refer to the signals utilizing symbols. The following is a list of the symbols used and a brief description thereof:

A0-A13 (Address bit 0 to address bit 13)
The 14 bit address used to access the memory.

ACNT (A Count)
The least significant bit of a counter which counts 1.1 microsecond memory cycles. ACNT is used to generate ATTN and SAH.

ATTN (Attenuate)
A logical signal which goes true for 100 nsec at 2.2 microsecond intervals four times during the time RUN is false. ATTN enables the counter which controls the attenuator to count if required by the overload detection circuitry.

CE (Chip Enable)
A logical signal which goes true once every memory cycle for 800 nsec. CE is required by the memory devices to clock in addresses and/or data for each bit read out of or written into memory.

STSM (Start Sample)
The 100 nsec carry out signal from the master counter when it passes a count of 225. STSM is used to initiate each sample period.

COUNT
A logic signal which enables the output of counter portion of the 3 high memory address stack to count.

D0-D7 (Data bit 0 to Data bit 7)
The 8 bits in the master counter which are latched to become the 8 bits of A-D conversion.

DINL, DINR (Data In Left, Data In Right)
Logical signals which are the A-D converted analog data as it is serially presented to the Left and Right memories.

HOSC (Half Oscillator Frequency)
A logical signal which is OSC divided by 2.
HOSC is used to count the master counter.

L0-L9 (Left data bit 0 to Left Data Bit 9)
The output bits from the memory for the left channel L8 and L9 are the floating point or attenuator bits.

LOAD
A 100 nsec logic signal which causes the 3 high memory address stack to rotate once. LOAD is applied to the XFR input of all counters and registers in the stack.

LOUT, ROUT (L Out, R Out)
The analog outputs of the L and R delay channels, respectively, after passing through the 4 pole output filters.

PRUN (Pre Run)
A signal which goes true 2.2 microseconds before RUN and is used to prevent a fifth ATTN pulse, and also to connect RAMP to the D/A converter before the start of RUN.

R0-R9 (R data bit 0 to R data bit 9)
Same as L0-L9, but for the R channel.

RAMP
An analog signal which is held at −5 V when RUN is false and increases linearly to +5 V when RUN is true. RAMP is used to both A-D and D-A conversion in both channels of delay.

RDL RDR (Read period L, Read period R)
Two consecutive 12.1 microsecond periods during which the read data for the L channel and R channel, respectively, are read out of memory.

RUN
A logic signal which is true during the last 51.2 microseconds of a sample period. During RUN, the master counter counts from 0 to 255 at 5 mHz, and the analog ramp runs linearly from −5 to +5 V.

OSC (Oscillator)
A constant frequency logic signal which is used to generate all timing and is the clock for much of the logic. The frequency is 10 MHz.

SAH (Sample-and-Hold)
A 2.2 microsecond wide logic signal which is true at the start of every sample period. It is used to sample and hold the input analog signal and for other timing purposes.

STOP
A logic signal which goes true after the longer initial delay has been counted down. STOP prevents the BCD down counter for the shorter initial delay from counting through zero twice.

WAIT
A logic signal which is true from the end of RDR to the start of WRT. During wait there is no accessing of the memory.

WE (Write Enable)
A 400 nsec logic signal which occurs once in every memory cycle during WRT. Each WE writes one bit into both the L and R memories.

WRT (Write)
A logic signal which is true for 12.1 microseconds starting at the end of RUN. WRT allows the writing of data into the memory.

Figure 2A:
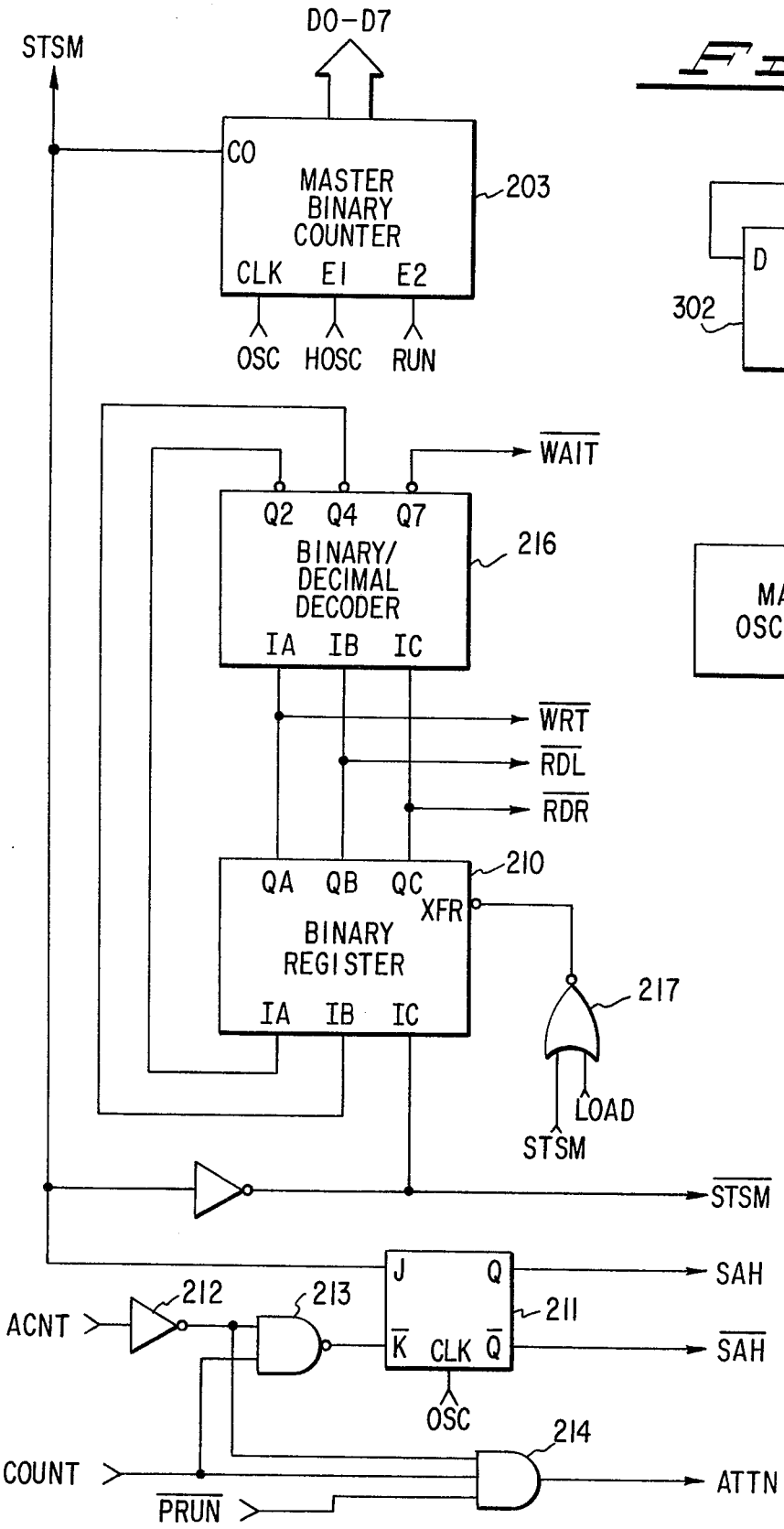
FIG. 2, comprised of FIGS. 2*a* and 2*b*, is a circuit diagram of the logical control signal generating portion of the Processor. In this, as in the other circuit diagrams, power connections are not shown since these connections are well known to those skilled in the art.
Figure 3:
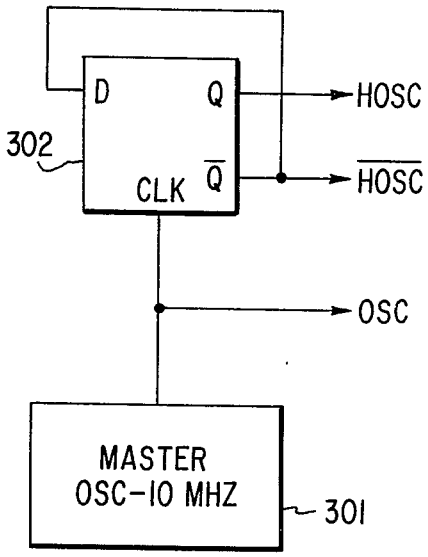
FIG. 3 is a circuit diagram of the master timing oscillator used to provide clock pulses to the logical elements.
Figure 2B:
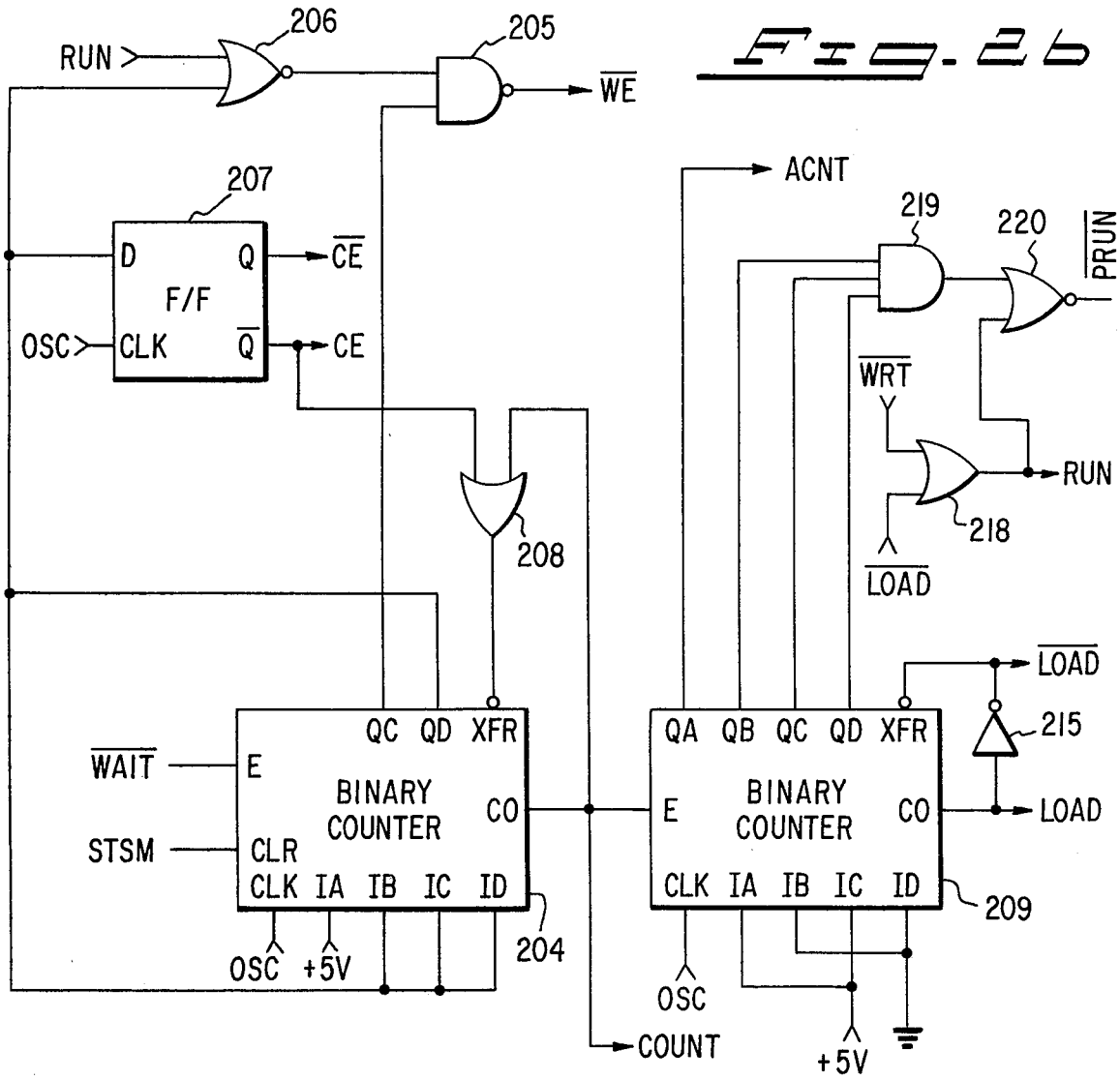

The logic control section circuitry, shown in FIGS. 2 and 3 includes a master oscillator 301 which generates a clock signal (OSC) at a 10 Mhz rate for timing the logic signals to be generated. Also included is a flip-flop 302 which provides logic signals at half the OSC rate (HOSC). The master oscillator 301 and flip-flop 302 control an 8 bit binary counter 203 (the master counter) which generates data bits D0-D7 at a 5 KHz rate while counting from 0 to 255 during RUN, the time that the ramp is traversing its range of −5 V to +5 V. At the end of each ramp sweep, that is, when the count on the master counter 203 passes 255 and clears, the master counter emits a carry out pulse (STSM) which is used to initiate the next sample period.

The STSM pulse at the start of each sample period clears a 4 bit binary counter 204 which is connected so as to generate a carry out pulse (COUNT) each 1.1 microseconds (11 counts of OSC) so long as the $\overline{\text{WAIT}}$ signal is true. As will be described below, the STSM pulse also sets $\overline{\text{WAIT}}$ true so that immediately after the STSM pulse, COUNT pulses will be generated each 1.1 microseconds. The QC and QD outputs of counter 204, in conjunction with NAND gate 205 and NOR gate 206, generates write enable bar ($\overline{\text{WE}}$) signals, which are 400 nanosecond signals occurring each 1.1 microseconds and spaced between the COUNT pulses, so long as RUN is false. The STSM pulse, as will be explained below also sets RUN false so that $\overline{\text{WE}}$ pulses will begin to appear about 300 nanoseconds after the STSM pulse.

D type flip-flop 207, coupled to the QD output of counter 204 generates the Chip Enable (CE) pulse which is an 800 nanosecond signal between each COUNT pulse. OR gate 208 feeds CE or COUNT to the XFR input of counter 204. The counting sequence of counter 204 proceeds as follows: following the STSM clearing pulse, all Q outputs are false and the counter starts counting up one bit on each OSC pulse, 0, 1, 2, . . . 8. At 8, QD goes true which applies a logical 1 to the IB, IC, and ID inputs. On the next OSC pulse flip-flop 207 switches so that CE drops false, and since COUNT is also low at this time, the output of OR gate 208 goes false, and on the next OSC pulse inputs IA, IB, IC, and ID (which are all at a logical 1) are transferred to the outputs QA, QB, QC, and QD. The output of counter 204 then represents a logical 15 which produces a carrry out pulse (COUNT). Thus, a cycle of 11 OSC pulses or 1.1 microseconds elapse between each COUNT pulse.

Counter 209, also a 4 bit binary counter is connected to provide a carry out pulse (LOAD) for each eleven count pulses applied to its enable input. Each LOAD output of counter 209 is coupled through inverter 215 to the XFR input of the counter. This transfers the logical 5, which is permanently wired to the I inputs, to the counting register of counter 209 so that the counter will clear and emit another LOAD pulse eleven counts later.

Counter 209 also provides an output (ACNT) at each alternate COUNT pulse, or each 2.2 microseconds. The ACNT signal is used to terminate the sample and hold period as will be explained below and to generate pulses (ATTN) to switch the attenuators.

The sample and hold signal (SAH) is generated by J-$\overline{K}$ flip-flop 211 and is a true signal 2.2 microseconds long at the beginning of each sample period. The STSM pulse at the beginning of the period is coupled to the J input of flip-flop 211 and sets its Q output true starting the sample and hold period. The ACNT signal from counter 209 is fed through inverter 212 to NAND gate 213, as is the COUNT pulse (which is the enable input to counter 209). The output of NAND gate 213 is therefore a short false pulse each time ACNT goes false. The false output of NAND gate 213, which is 2.1 microseconds later than the beginning of the SAH period, is coupled to the K input of flip-flop 211 and resets Q false to terminate the sample and hold period.

Just prior to the beginning of a sample period the QA, QB, and QC outputs of registers 210 are all true and binary to decimal decoder 216 decodes this condition as a false output on its Q7 output ($\overline{\text{WAIT}}$). When the STSM pulse occurs NOR gate 217 couples a logical 0 to the XFR terminal of register 210 which then transfers the data at its input terminals into the register. IA and IB will both be true while IC will be false. QC will then drop to a logical 0 initiating the start of the WRT period. Decoder 216 decodes this as a false output on its Q4 output and when the first LOAD pulse of the sample period arrives, NOR gate 217 will cause the output of register 210 to assume a false output on its QB output, QA and QC being true. This is the read L channel condition. The next load pulse shifts register 210 again so that QA is false, the read R channel condition and the final load pulse returns register 210 to its original all true output or $\overline{\text{WAIT}}$ false condition.

A RUN signal is generated by OR gate 218 in response to $\overline{\text{WRT}}$ or $\overline{\text{LOAD}}$. The $\overline{\text{LOAD}}$ input to OR gate 218 enables RUN to begin at the required time in synchronism with COUNT, and $\overline{\text{WRT}}$ maintains it during the balance of the sample period.

The QB, QC, and QD outputs of binary counter 209 cause AND gate 219 to go true when counter 209 reaches a count of 14, 2.2 microseconds before LOAD, that is, on the ninth COUNT pulse after STSM. $\overline{\text{PRUN}}$, the output of NOR gate 220, then goes false and RUN maintains the false signal during the balance of the sample period.

When COUNT, $\overline{\text{ACNT}}$, and $\overline{\text{PRUN}}$ are all true, AND gate 214 will generate an ATTN pulse. Since $\overline{\text{PRUN}}$ becomes false 9.9 microseconds after STSM, and $\overline{\text{ACNT}}$ is false during alternate COUNT pulses, there will be 4 ATTN pulses spaced 2.2 microseconds at the beginning of each sample period.

MEMORY CONTROL

The signals in each channel which are to be delayed are sampled, as will be described in detail later, at an approximate 16 KHz rate (63.3 microseconds per conversion period), and each of the samples is converted to a 10 bit digital "word" to be stored in a random access memory (RAM). The individual samples are stored for about one tenth of a second each to provide for the desired delay range, which means that memory capacity for about 30,000 bits of information must be provided, 15,000 for each channel. This capacity may be realized with 2-16,384 bit RAMs, one for each channel, or any other grouping of memories which will comprise the same capacity; for example, 8-4,096 bit memories. Memory storage for 1638 10 bit words per channel is thus provided. The odd four bits of available memory storage are unused. The bits making up the words are stored at addresses in numerical sequence in each of the RAMs, that is the first word is stored at addresses 0–9, the second at 10–19, etc. up to the last word at 16370–16379. The addresses are carried in the form of 14 bit binary numbers, ten such addresses comprising the location of a word.

Figure 5:
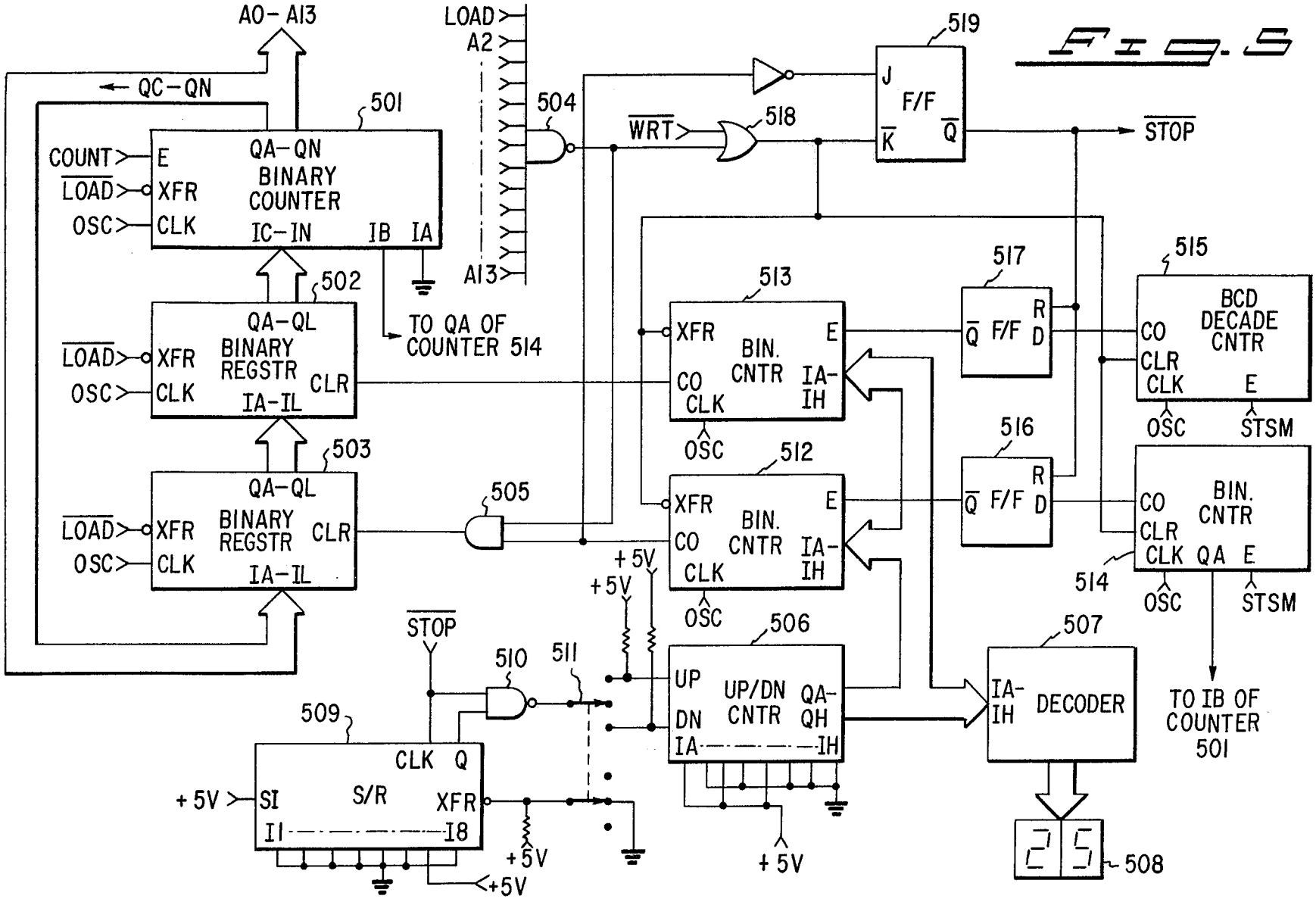
FIG. 5 is a circuit diagram of the memory control and delay set portion of the circuit.
Figure 6A:
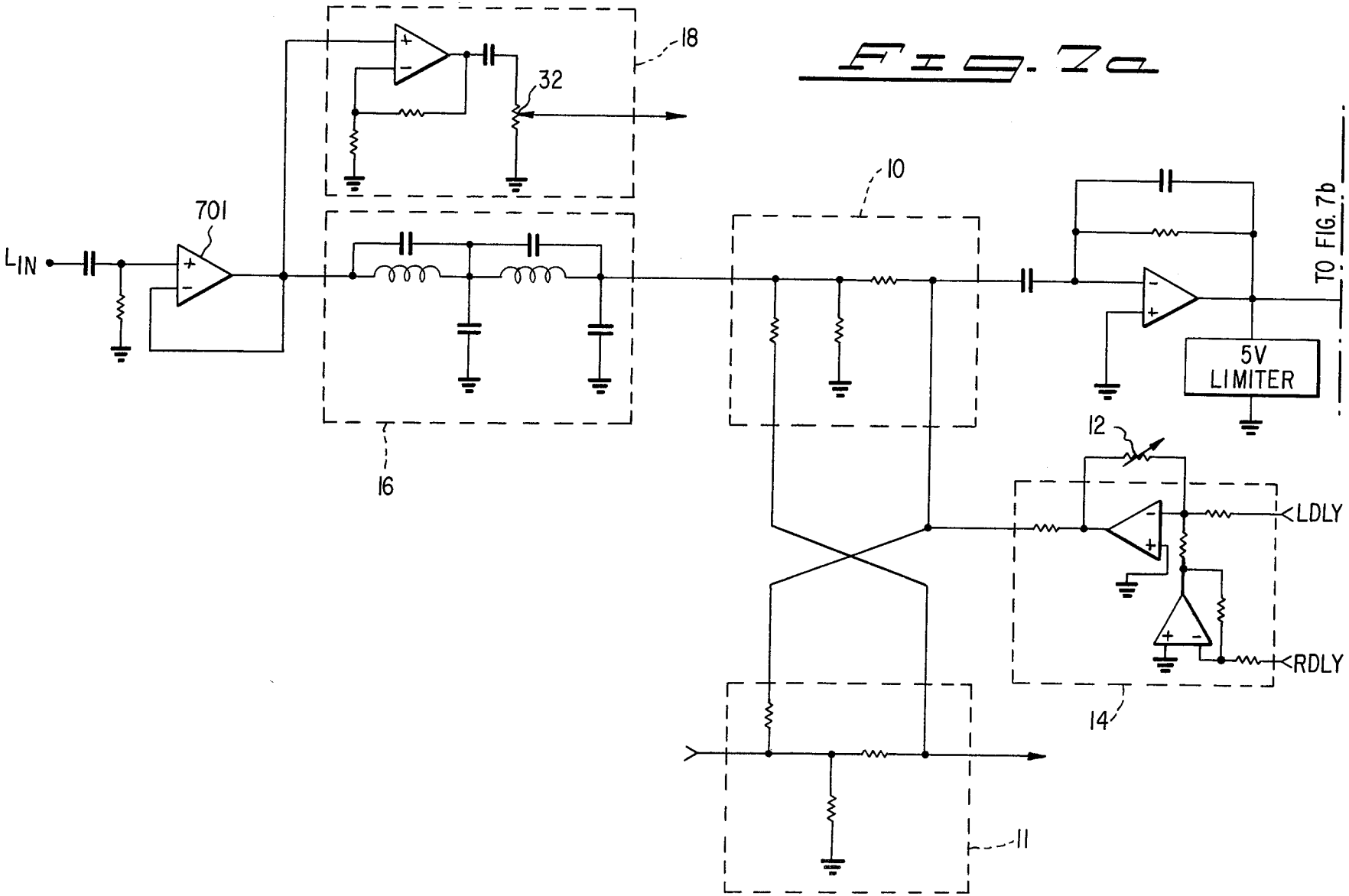

During the sampling time, but subsequent to the entry of a word into the memory, a word which had been stored some time previously is read, and the data is transmitted to the digital to analog conversion section of the processor for reconstruction of the stored signal. The storage and retrieval of data is under control of the delay section of the processor, the circuitry of which is depicted in FIG. 5.

During each sample time, three groups of ten addresses must be generated, one representing the location where a new signal amplitude in digital form is to be stored in each memory, and two addresses representing locations of previously stored signal amplitudes which are to be read out of the memories. Only one address is needed to write both channels of data into the memories since signals from each channel which are digitized at the same time are stored at the same address, one in one RAM and the other in the other RAM. Two addresses are needed to read the data, however, since the two channels utilize different delay times and thus the data to be read are at different addresses.

The three addresses required during a sample period are generated and stored in a "stack" of one binary counter and two registers. The counter and registers are shown in FIG. 5 as 14 bit and 12 bit units for convenience, even though as a practical matter such counter may comprise, for example, three 4 bit and one 2 bit counters cascaded and the registers can be made up of three 4 bit registers. The addresses as coupled to the memories appear as the outputs A0–A13 of the top section, of the stack, counter 501, while registers 502 and 503, the middle and bottom sections of the stack store addresses to be fed upward in the stack at the appropriate times, as will be explained below. This transfer of data is made possible by connecting the outputs of register 502 to the data input of counter 501 and the output of register 503 to the data input of register 502. The data inputs of register 503 are connected to the outputs of counter 501. A transfer signal ($\overline{LOAD}$) applied to the XFR terminal of counter 501 and registers 502 and 503 causes the stack to "rotate", the output count of register 502 being transferred to the output of counter 501, etc.

At the start of the sample period the output count of counter 501 corresponds to the first address at which a bit of data is to be written into the memories for that particular sample period, for example, 12340. Successive COUNT pulses advance counter 501 one count at a time (one bit of a 10 bit word being written into each memory at each count) until counter 501 reaches a count 10 counts higher (12350 in the example). The next COUNT pulse does not advance counter 501 since simultaneously a $\overline{LOAD}$ pulse appears which disables the counting function and causes the stack to rotate.

The count which had been in register 502, which corresponds to the 12 most significant bits of the first address of the L channel to be read, is transferred to counter 501, and the reading of the memory corresponding to the L channel RAM 26 commences.

Since the initial address for each 10 bit word to be written into or read out of the memories always ends in zero, and the initial address for successive words of the same series (WRT, RDL, or RDR) differ from the previous address by 10 addresses, the two least significant bits of the addresses follow a pattern which makes it possible to utilize 12 bit registers 502 and 503 to load 14 bit counter 501 with the required initial address. The 2 least significant bits of the addresses to be loaded into counter 501 each time the stack is rotated can be obtained from the other logical signals available. The least significant bit of the initial address is always zero, so that simply grounding the IA input of counter 501 provides the correct input. The required IB input to counter 501 alternates between a logical 1 and a logical 0 during alternate sample periods, and such a signal is available from the QA output of counter 515 which, as will be explained below, is incremented one count at the beginning of each sample period.

The means of establishing the difference in addresses used for reading data out of the memories so as to correspond to the desired delays will be described below, but for purposes of explanation of the operation of the stack and memories, assume that a delay of 4000 addresses (corresponding to about 25 milliseconds) has been set into the L channel read register, with respect to the addresses of data being written during the write period.

Thus the count transferred from register 502 to counter 501 when the stack is rotated at the beginning of the RDL period, in the numerical example being used, will be 8340. This count is advanced by 10 during the 10 subsequent COUNT pulses. Each address is coupled to the RAM 26 where CE pulses enable the reading of the word stored at addresses 8340 to 8349. The addresses are also coupled to RAM 27, but the output of RAM 27 is gated open during this period, as will be explained below, and the address signals thereto have no effect. Since the last COUNT pulse in the series advances the count of counter 501 to 8350, the bit at this address is also read, but is not utilized further.

After the count in counter 501 has been advanced 10 counts during the RDL period, another $\overline{LOAD}$ pulse appears and the "stack" rotates once more bringing the count which was stored in register 503 at the start of the sample period to counter 501. Continuing with the same numerical example as above, the count transferred to counter 501 would be 5940. This is because the ratio of the left delay to the right delay is always $\frac{5}{8}$ or 4000/6400. The initial count of counter 501 (12340) less 6400 equals 5940. The delay of 6400 addresses corresponds to a delay of about 40 milliseconds. In a manner similar to that described above with respect to the reading of the L channel data, 10 COUNT pulses advance counter 501 while the R channel data is being read.

Thus, during the first 36.3 microseconds of each sample conversion period, three groups of 10 addresses are generated by the "stack" which correspond, respectively, to the addresses for writing a new sample from each channel into the memories, for reading a previously written in sample from the L channel RAM, and reading a previously written in sample from the R channel RAM.

The counter 501 has a maximum count capacity of 16384 rather than 16380 as is required for continuous recycling at 10 counts per word. Consequently, NAND gate 504 is provided to detect a count of 16380 in counter 501 and to cause register 503 to clear instead of accepting the count of 16,380 when the stack next rotates. This clearing is accomplished through AND gate 505 to the CLR terminal of register 503.

DELAY CONTROL

As noted above, data is read out of memories 26 and 27 some period of time after the data is written in by accessing addresses during the read periods corresponding to earlier written data. Since the addresses of the written data are in numerical order, the desired delay can be accomplished by simply accessing addresses for reading data some number less than the addresses being accessed for writing data.

A single control is utilized for setting both delays inasmuch as the shorter delay (L channel) is always maintained at $\frac{5}{8}$ of the longer delay (R channel). Two digit BCD up/down counter 506 is used to set the delay, its output count being the longer delay in milliseconds.

When the processor is first energized, the connections to the I inputs of counter 506 cause it to be set for a delay of 25 milliseconds, but if some other delay is preferred the counter can be incremented (or decremented) as desired by actuating switch 511. When switch 511 is in its neutral position, the ground on the XFR terminal of 8 bit shift register 509 cause it to be continuously loaded with a logical 1 signal in its seventh stage and logical 0 in all of the other stages. When the switch is actuated in either direction a STOP signal (which will be explained later) applied to the CLK terminal shifts the register at approximately 0.1 second intervals. Counter 506 will therefore be incremented (through NAND gate 510) once, 0.1 seconds after switch 511 is actuated, followed by a delay of about 0.6 seconds and then a series of counts at 0.1 second intervals as long as switch 511 is depressed. This allows any number between 0 and 99 to be conveniently set into counter 506. Counter 506 is incremented or decremented depending on which direction switch 511 is actuated.

The output of counter 506 is coupled to two 2-digit BCD down counters 512 and 513. Down counter 512 controls the longer of the two delays, (that is, the R channel delay), while counter 513 controls the shorter delay, which is always $\frac{5}{8}$ of the longer delay, and is the delay of the L channel.

Another pair of counters 514 and 515 each acting through a D type flip-flop (516 and 517) cause the counters 512 and 513 to count down. The counters 514 and 515 are incremented by the STSM pulses, which it will be recalled occur every 62.3 microseconds. Counter 514 is a 4 bit binary counter and consequently it will emit a carry pulse every 996.8 microseconds (rounded off to 1 millisecond for purposes of this description). Counter 515 is a decade counter and will therefore emit a carry pulse every $\frac{5}{8}$ millisecond.

The coincidence of a count of 16380 in counter 501, and a LOAD pulse, causes NAND gate 504 to go false. This false signal and a WRT false signal causes OR gate 518 to go false. This situation can only occur when the counter which contains the write address (counter 501) is about to be cleared, and occurs at the same time that the write address is being set to zero. Gate 518 going false causes the count set in counter 506 to be transferred to the output registers of counters 512 and 513. The down counters 512 and 513 will then count down in millisecond and $\frac{5}{8}$ millisecond increments, respectively, from the time the write address is zero. Assuming the same numerical example as previously used, that is, a set delay of 40 milliseconds, counters 512 and 513 will have been preset to 40 by counter 506, and since counter 513, is being decremented each $\frac{5}{8}$ milliseconds, it will therefore reach zero in about 25 milliseconds in synchronism with an STSM pulse. The carry pulse emitted by counter 513 on reaching zero, is coupled to register 502 to clear it. Since at the time of the STSM pulse the state of the stack rotation is such that register 502 holds an address destined to be used to read the L channel memory, it can be seen that the addresses used to read the L channel memory will always lag the write addresses by $\frac{5}{8}$ of the count set into counter 506, in milliseconds.

Counter 512, in the meantime is being decremented at 1 millisecond intervals and will reach zero in about 40 milliseconds. The carry pulse from counter 512 is coupled through gate 505 to clear register 503, which at that moment is holding an address destined for reading the R channel memory. Thus, the addresses for reading the R channel memory are made to lag the write addresses by the count set into counter 506, in milliseconds.

In order to avoid the possibility of counter 513 counting through zero twice between complete memory address scans, $J\overline{K}$ type flip-flop 519 disables the flip-flops 516 and 517 after register 503 has been zeroed, until the delay time is again set into the down counters 512 and 513 from counter 506.

The $\overline{Q}$ output of flip-flop 519 ($\overline{STOP}$) is also used to increment shift register 509, the source of pulses for changing the set delay.

RAMP GENERATION

Figure 6:
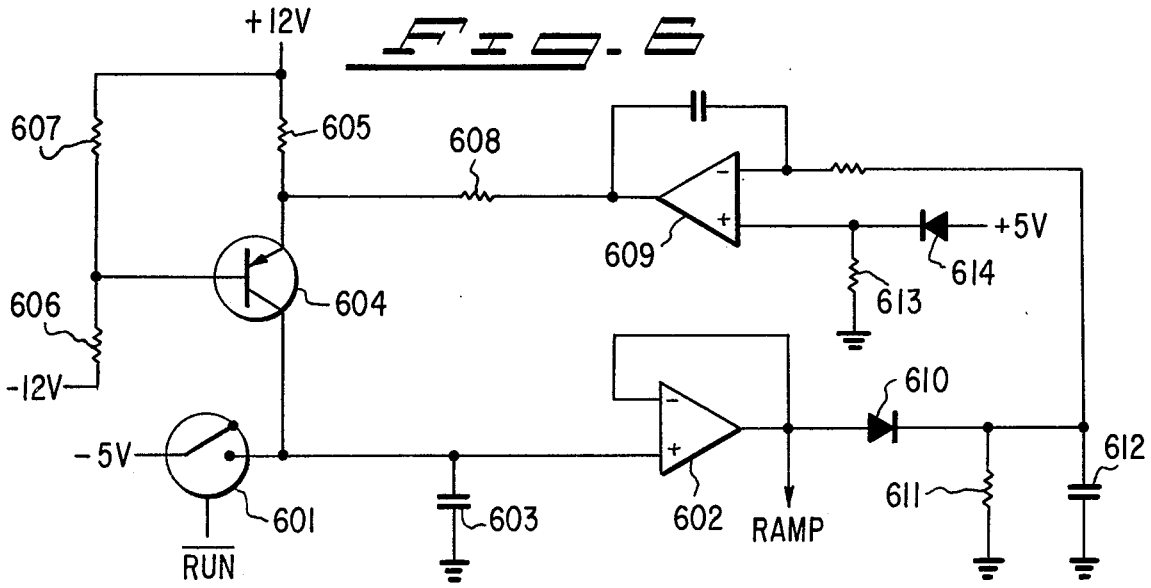
FIG. 6 is a circuit diagram of the ramp generator.
Figure 4:
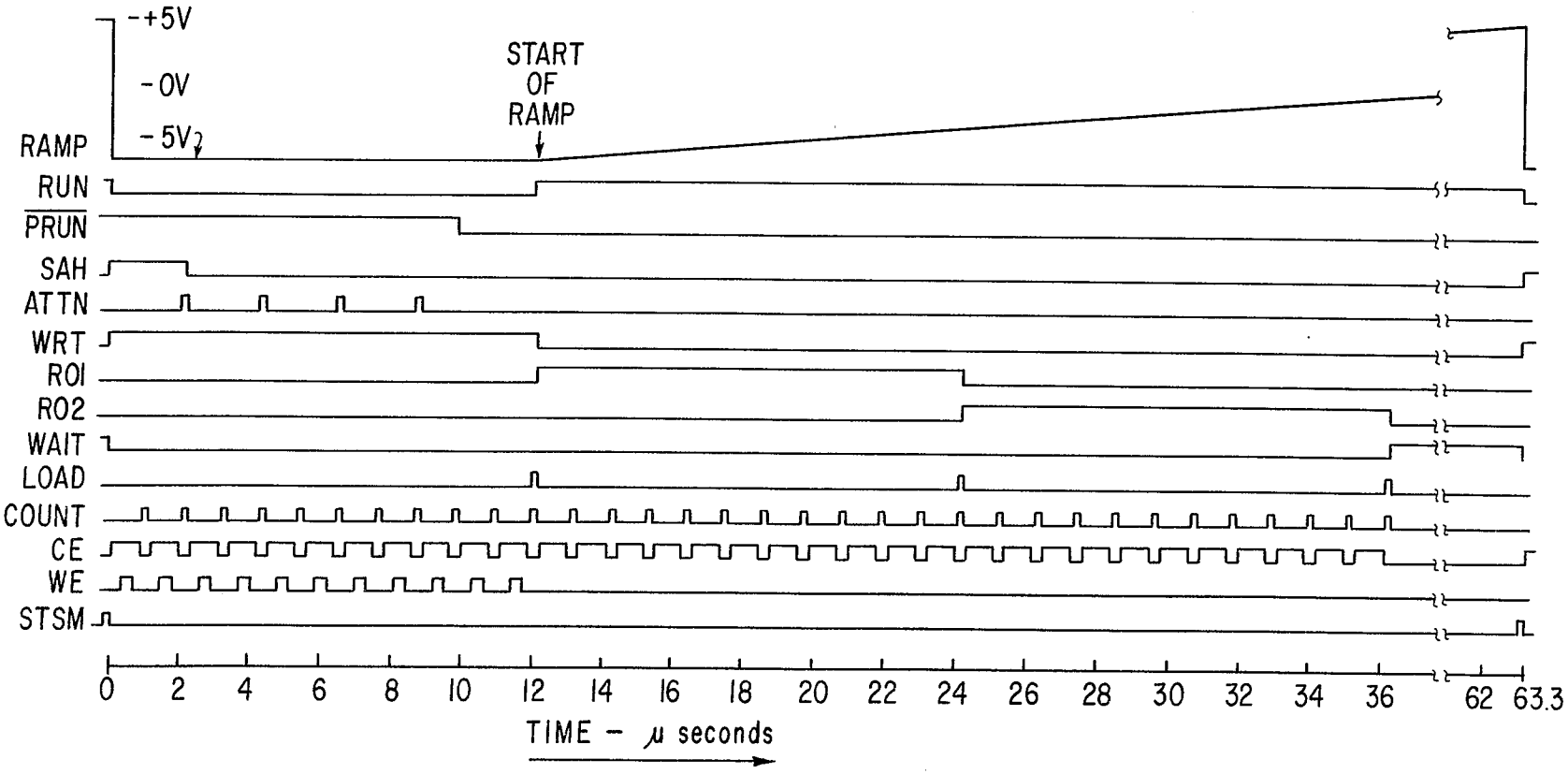
FIG. 4 is a general timing diagram of the processor.

The ramp generator, shown in FIG. 6 is controlled by the $\overline{RUN}$ signal which is false for the last 51.2 microseconds of each sample period (during the time the ramp traverses its range of −5 V to +5 V). During the write period, the first 12.1 microseconds of the sample period, $\overline{RUN}$ is true and electronic switch 601 is actuated so that the positive input to amplifier 602 is −5 V. Amplifier 602 is connected as a voltage follower so that its output is also at −5 V. At the start of the ramp period $\overline{RUN}$ goes false and switch 601 opens which allows capacitor 603 to begin charging through transistor 604. The charging current is supplied from +12 V through resistor 605 and from the output of amplifier 609 through resistor 608. Transistor 604, in conjunction with resistors 605, 606, 607 and 608 comprise a constant current source, the magnitude of which current depends upon the output voltage of amplifier 609.

Diode 610, capacitor 612, and resistor 612 are a ramp voltage detecting network and capacitor 612, after several ramp cycles, will charge to essentially the peak ramp voltage, less the forward voltage drop of diode 610. This voltage is applied to the inverting terminal of amplifier 609. The noninverting terminal of amplifier 609 is connected to a network comprised of diode 614 and resistor 613 which applies a voltage of 5 volts, less the forward voltage drop of diode 614, thereto. If the peak ramp voltage is less than 5 volts, the output of amplifier 609 will be positive and the charging current to capacitor 603 will be higher than if the peak ramp voltage were higher than 5 volts. Since the gain of amplifier 609 is relatively high, the circuit described is a charge current regulating circuit which ensures that the peak ramp voltage is always exactly 5 volts.

At the expiration of the sample period $\overline{RUN}$ again becomes true, electronic switch 601 closes and capacitor 603 quickly discharges dropping the ramp voltage to −5 volts.

INPUT AND A/D CONVERSION

Figure 7B:
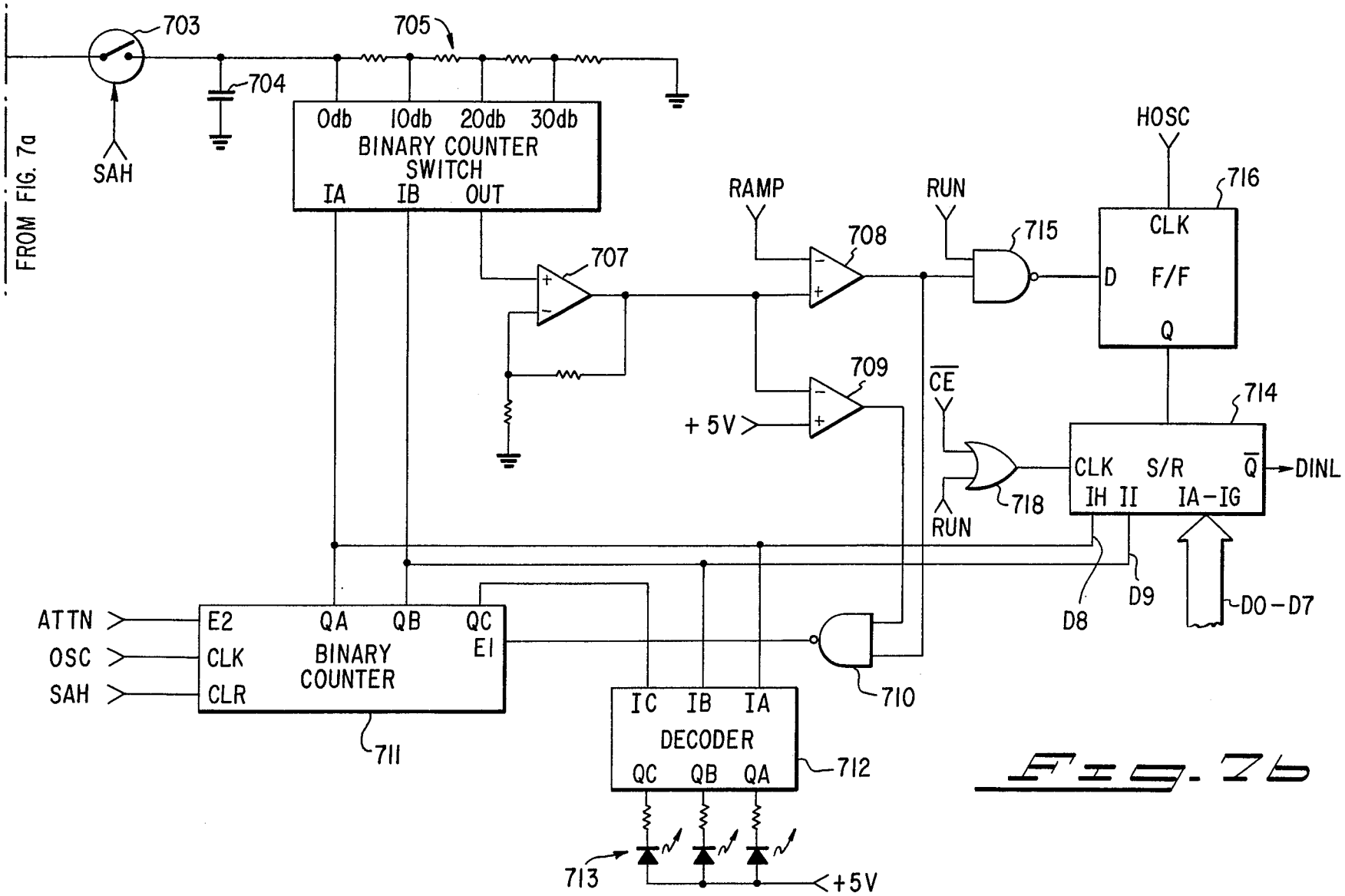
FIG. 7, comprised of FIGS. 7*a* and 7*b*, is a circuit diagram of the analog input and analog to digital converter portions of the processor.
Figure 9:
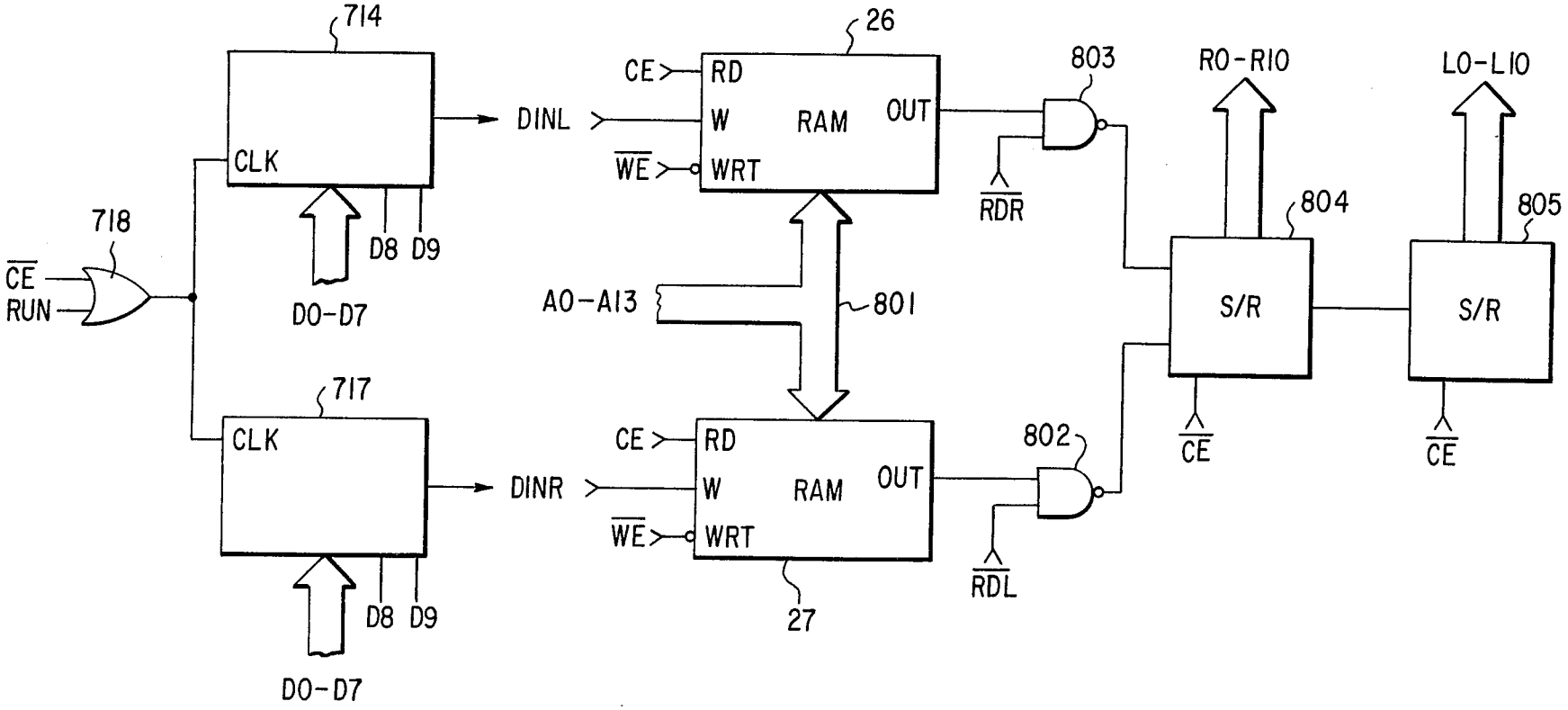
FIG. 9 is a circuit diagram of the digital to analog converter and output portions of the Processor.
Figure 9:
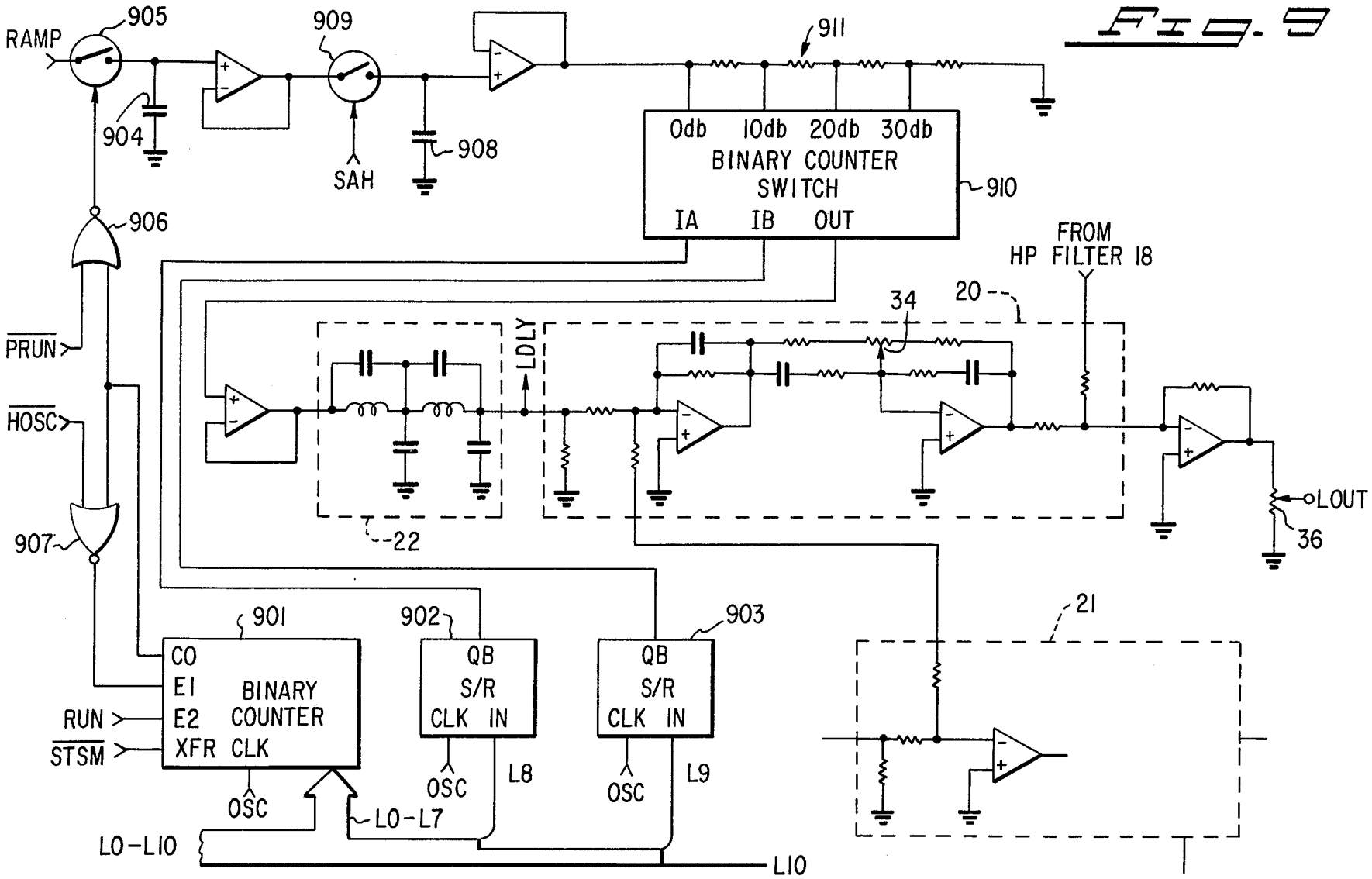

FIG. 7 shows the circuitry of the input and Analog to Digital Conversion portions of the processor.

For clarity and ease of explanation, only the L channel is shown along with only so much of the R channel as is required to show the interconnections. The two channels, as noted previously are identical.

An input buffer amplifier 701 provides isolation from the driving stereophonic system and no input gain controls need be provided. As will be noted later, the processor digitizes a range of input signals of 80 dB without the necessity of changing any gain settings.

Low pass filter 16 follows the input buffer amplifier and attenuates any program material components over 6 KHz so as to prevent distortion from being introduced by the sampling process involved in the conversion of the signals to digital form. It is well known that in sampled data systems, if the sampling rate is high enough to obtain two samples of the signal per cycle of the highest frequency component present, the signal can later be reconstructed without distortion due to the sampling method. On the other hand, if higher frequency components are present, the reconstructed signal will contain components not present in the original signal and thus will be distorted. By filtering out components of the incoming signals greater than 6 KHz, and sampling at a 16 KHz rate, this source of distortion is avoided. The high frequency components of the program material are fed through high pass filter 18 directly to the output section.

Input mixer 10 may simply be a network of resistors to sum the various voltages to be mixed. As noted previously, input mixer 10 sums the signals in the ratio of 100% of L channel input with 50% of the R channel input, and from zero to 100% of the "ambience" signal from ambience mixer 14, which in turn is a mixture of 33% of L channel delayed output (LDLY) minus 40% (inverted signal) of R channel delayed output (RDLY).

A 5 volt limiter 702 is provided so as to prevent overloading of the D/A converter.

The mixed and filtered input signal, which includes the then current input to the L channel, a portion of the then current input to the right channel, and an "ambience" signal containing many echo components, is sampled at the beginning of each sample conversion period by sample and hold switch 703 and capacitor 704, as can be seen in FIG. 7. Sample and hold switch 703 is actuated by the SAH signal which is true for the first 2.2 microseconds of each conversion period.

The voltage held on capacitor 704, which represents the instantaneous mixed input signal voltage during the 2.2 microsecond SAH period, is applied across attenuator 705 which has 4 output steps, of 10 db each.

Electronic tap switch 706, which is controlled by a binary signal input, is set at its first position, or 0 db at the end of the SAH period and thus its output will equal the sampled voltage on capacitor 704. This voltage, after being amplified by 30 db by amplifier 707, is applied to the inputs of the two comparators 708 and 709. Comparator 708 has its inverting input connected to the ramp voltage (RAMP) and amplifier 709 has its non inverting input connected to +5 volts. Since the ramp voltage at that moment is −5 volts, the combination of comparators 708 and 709 comprise a comparison circuit which detects whether the voltage at the output of the attenuator is within the range, plus or minus 5 volts. If the voltage detected by comparators 708 and 709 is greater than +5 volts or less than −5 volts, NAND gate 710 will go true. The output of NAND gate 710 is coupled to one of two count enable terminals of binary counter 711. The other enable terminal is coupled to ATTN, and the clear terminal is coupled to SAH. During the SAH period counter 711 is cleared by SAH, and the next ATTN pulse (2.2 microseconds after the end of the SAH period) enables counter 711 to increment one count if the other enable input which is coupled to the comparison circuit is true. If the sampled input voltage on capacitor 704 is within the range plus or minus 5 volts, counter 711 will not step, but if the voltage is outside the range, the counter will step once applying a binary 01 to switch 706. A binary 01 at switch 706 input causes it to switch to the −10 db tap of the attenuator 705. If this attenuation brings the input voltage to the comparison circuit within the + or −5 volt range, gate 710 will go false and counter 711 will not again increment. If the voltage does not come within the plus or minus 5 volt range when the attenuator is on the −10 db step, the counter will increment again at the next ATTN pulse 2.2 microseconds later causing a binary 10 to be applied to switch 706 which steps the switch to the −20 db tap. If the voltage is still not within range, the switch 704 will be stepped to the −30 db tap at the next ATTN pulse (a binary 11 of counter 708). The −30 db tap is the greatest attenuation step available and limiter 702 assures that the voltage input to comparators 708 and 709 at this attenuation will be within the + or −5 volt range.

Decoder driver 712 is also coupled to the output of counter 711 and together with LED lamps 713 allows the user to be aware of the attenuations being utilized by the program material. The lamps 713 signify −10 dB, −20 dB, and −30 dB attenuation in each channel.

At the start of the digitizing period (12.1 microseconds after the start of the sample conversion period), the RUN signal goes true and RAMP starts its traverse from −5 volts to +5 volts. Assuming no overload condition, the attenuator 705 is set such that the voltage at the input of amplifiers 708 and 709 is between −5 volts and +5 volts.

It will be recalled that master counter 203, an 8 bit binary counter, counts during the time that RUN is true, going from a count of 0 to 255 in that time, count 256 clearing the counter and generating the next STSM pulse. The output counts of counter 203, D0–D7, are coupled to the corresponding data input terminals of parallel in/serial out shift register 714 and the QA and QB outputs of counter 711 are coupled to the IH and II inputs. When RAMP starts at −5 volts, the amplifier 708 is saturated positive since the signal input is more positive than the ramp. The output of NAND gate 715 is therefore false. Sometime during RUN, the ramp voltage will cross the signal voltage at the input of amplifier 708 and at that moment gate 715 will go true and flip-flop 716 will cause the data inputs IH-II to register 714 to be latched into the register. The 10 bits latched into register 714 are 8 bits which represent the instantaneous voltage at the input to amplifier 708, and 2 bits which represent the amount of attenuation being used. The 10 bits taken together then are representative of the voltage on capacitor 704.

The data latched into shift register 714 (and that latched into a companion shift register 717 in the R channel) will be written into memory during the first 12.1 microseconds of the next sample conversion period, during the time the input signal for the next conversion is being sampled, and the attenuator set.

The unique means of encoding the amplitudes of the signals used in the A/D converter results in a greater dynamic range than is possible using conventional techniques. The quantizing noise of the ramp conversion can be shown to be 50 dB below the maximum sine wave signal, which, when added to the 30 dB of attenuation available through the step attenuator results in a total dynamic range of 80 dB with only 10 bits of data. Conventional A/D converters require 13 bits of data to achieve a similar dynamic range.

MEMORY

At the start of the sample conversion period as signified by the STSM signal, the write period commences. During this 12.1 microsecond period the 10 bit words stored in shift register 714 and its R channel companion 717 during the previous sample conversion period are simultaneously written into RAMs 26 and 27 at ten consecutive 14 bit addresses as generated by counter 501. The same address is used in both RAMs to store the information written at the same time. When the write period commences, the count of counter 501 is the first address of the sequence for the word to be written and this address is coupled to RAMs 26 and 27 over bus 801.

OR gate 718 is used to shift the data out of shift registers 714 and 717 into RAMS 26 and 27. At the time of the STSM pulse, gate 718 is true, and had been true since the end of the previous write period because of the RUN signal. About 400 nanoseconds after the STSM pulse $\overline{WE}$ goes false, and the first bit of the 10 bit word to be written into memory is written in. Subsequently $\overline{CE}$ goes true and shift registers 714 and 717 shift the next bit to their outputs DINL and DINR, and on COUNT, counter 501 increments once. The next $\overline{WE}$ pulse then writes this data into memory and so on until all 10 bits have been written in at 10 successive addresses. It may be noted that there are 11 WE pulses during the write period and that a zero will be written into the eleventh address to appear. However, this address is really the first address for the next word, and since the write address counter will not be incremented before the next sample period, the proper data will be written into memory at that address during the next period.

At the end of the write period, the stack is rotated bringing the address of the first data point to be read in the L channel to the register of counter 501. The RAMs are interrogated by the CE pulses, the contents of the address inputted on bus 801 appearing at the RAM OUT terminal during the time CE is true. Since $\overline{RDL}$ is false and $\overline{RDR}$ is true during the read L period NAND gate 802 does not respond to outputs of RAM 27 but NAND gate 803 does respond and passes a logical 0 to shift register 804 each time RAM 26 outputs a logical 1, and vice versa. After 10 CE pulses, the entire word corresponding to a particular data point will have been clocked into shift register 804. The next COUNT pulse increments counter 501 to the first address of the next L channel word and the contents of this address is also outputted to shift register 804. As will be seen later, this apparently improper operation does not interfere with the data flow since this position in the word read out will be ignored. Nor does it interfere with the proper reading of the word during the next sample period since the counter is not incremented again before the next word is read.

At the end of the read L period, the stack is rotated again by a LOAD pulse bringing the address of the first bit of R channel word to be read to the register of counter 501. Now $\overline{RDR}$ is false and $\overline{RDL}$ is true so that RAM 27 can be read out through NAND gate 802 while NAND gate 803 renders RAM 26 inactive. Eleven data points are read into shift register 804 in the same manner as occured during the read L period. The L channel data is shifted from shift register 804 into shift register 805 as the data is read from RAM 27.

At the end of the read R period, shift register 805 contains a 10 bit word representing the amplitude of an L channel signal which has been delayed by $\frac{5}{8}$ of the initial set delay, plus one bit of superfluous data, and shift register 804 contains a 10 bit word representing the amplitude of an R channel signal delayed by the amount of the set delay, plus one bit of superfluous information. This data appears as parallel outputs of shift registers 804 and 805 on lines L0–L10 and R0–R10. It should be noted that the data in shift registers 804 and 805 are actually the complements of the digitized amplitudes stored in RAMs 26 and 27.

D/A CONVERSION AND OUTPUT

By the end of the read R period of any sample conversion period, two words have been read out of RAMs 26 and 27, one out of each, and their complements set into shift registers 804 and 805 as described in the previous section. These words are reconverted to analog signals in the output D/A converter, filtered, and coupled to the outputs of the processor. Again in explaining the D/A conversion and output section, only the L channel will be described since the R channel is identical.

In the L channel, lines L0–L17 from shift register 805 are coupled to counter 901, and lines L8 and L9 are coupled to shift registers 902 and 903 respectively. L10 does not contain useful data and is not connected. The first STSM pulse after the data read periods sets the count on L0–L7 into the register of counter 901 and the counts on L8 and L9 into the input registers of shift registers 902 and 903.

$\overline{PRUN}$, acting through NOR gate 906 closes electronic switch 905 prior to the starting of the ramp, and capacitor 904 charges to ramp voltage. Since the ramp generator has a low impendance output, the addition of capacitor 904 does not appreciably affect the ramp voltage and capacitor 904 follows the ramp essentially instantaneously.

As the ramp rises from −5 volts to +5 volts, counter 901 counts upward from its preset count of the complement of the data read out of memory. The counting is at the rate of HOSC since $\overline{HOSC}$ is coupled to one of the enable terminals of the counter through NOR gate 907. When the counter 901 overflows, the carry pulse it emits stops the count through gate 907 and disconnects RAMP from capacitor 904 through gate 906. The charge on capacitor 904 is now exactly the voltage which had originally been digitized and placed into memory, since the count from the present complement to overflow is the same as the original digitizing count, and the voltage orginally digitized was equal to the value of RAMP at that instant. Setting the complement of the required count into a counter and counting up until the counter clears is equivalent to setting the actual required count into the counter and counting down to zero. It should be noted that the linearity of the ramp or absolute values of the ramp do not affect the accuracy of the conversion since the same source of ramp voltage is used both in the A/D and the D/A steps. The only requirement as to the ramp is that it remain stable for the delay time, i.e. up to 0.1 second.

At the beginning of the next sample conversion period, the SAH signal causes electronic switch 909 to close for 2.2 microseconds, charging capacitor 908 to the same voltage as capacitor 904. The STSM pulse advances shift registers 902 and 903 so that the data L8 and L9 corresponding to the voltage on capacitor 908 are shifted to the second cells of the registers and appear at the QB outputs. These outputs are coupled to the data input terminals of switch 910. The binary number coupled to the data input terminals of switch 910 determines which tap of attenuator 911 is selected by the switch. The attenuator taps are in 10 db steps as were those of switch 706, but in inverse order, that is, the code generated by counter 711 which sets switch 706 to 0 db corresponds to the code from registers 902 and 903 which sets switch 910 to −30 dB. Thus, switch 910 in effect de-attenuates that which switch 706 attenuated.

The reconstituted signal at the output of switch 910 is precisely the signal which was present at the output of low pass input filter 16 at a previous time. The time difference or delay is the difference which corresponds to the difference in addresses between the addresses in counter 501 during the WRT period and those in register 502 during the corresponding RDL period. This difference in time, as explained previously, is $\frac{5}{8}$ of the time in milliseconds displayed on LED display 508. In the case of the R channel signal, the time delay is equal to the number displayed, in milliseconds.

Output low pass filter 22 is similar to filter 16 and removes the sampling irregularities prior to output mixing. The output mixing and level setting may be accomplished by conventional means well known to those skilled in the art and need not be described in detail here. The output mixer 20 mixes in the ratio of 100% of L channel signal with 0 to 200% of the high frequency L channel input signal as controlled by potentiometer 32, corresponding to a maximum of treble boost of 6 dB.

Output mixer 20 also mixes 33% of the output of the R channel with the other signals mixed.

The two outputs LOUT and ROUT may be connected, through appropriate power amplifiers to loudspeakers which are preferably placed generally behind or to the sides of the listeners and which will project sounds rich in synthesized reflections to simulate the reverberation which would have existed had the program been played in the room or auditorium whose characteristics are modeled by the Processor. Increasing the set delay causes the initial reflections to be later in time and subsequent reflections to be spaced further apart which provides the sensation of a larger auditorium. Increasing the level of the "ambience" signals fed back from the output reduces the decay rate of the echoes and so allows each echo to persist longer, giving the illusion of an auditorium with greater "liveness".

FIG. 10 depicts a plan view of one possible listening environment and shows the interconnections between the various components of the total system. Along one wall of room 1001 there is shown a pair of loudspeakers 1002 and 1003 which project the L and R channel signals respectively of a stereophonic audio system. The system is shown comprised of a stereo program source 1004, which can be any desired source such as a tape deck, phono pickup, tuner, etc., a stereo preamp 1005, and a stereo audio amplifier 1006. The invented Digital Delay Audio Processor 1007 accepts the outputs of preamp 1005 and drives auxiliary loudspeakers 1008 and 1009 through stereo audio amplifier 1010. The auxilliary speakers as shown are alongside the listeners. In order to achieve the desired auditorium ambience, the delay and "ambience" settings should be made on the processor appropriate to the characteristics of the phantom listening environment being simulated and the volume of the auxiliary loudspeakers set low enough so that the sounds therefrom are not sensed as a separate sound source. The sounds from the auxilliary speakers, in conjunction with those from the primary loudspeakers will then create the illusion of a phantom listening environment having a size and liveness as set.

What has been described is a preferred embodiment of the present invention which illustrates one aspect of the present invention, namely the synthesizing of simulated reverberation signals from a conventional stereophonic input signals whereby the ambience of an auditorium can be simulated. Various adaptations and changes in the apparatus and various other applications of the principles disclosed will occur to those skilled in the art and are intended to be covered hereby. For example, public address systems for large areas commonly utilize a plurality of spaced loudspeakers to cover the entire area so that there will be relatively uniform volume throughout the area. Since sound in air travels much slower than the electrical signals to the loudspeakers, it is desireable to artificially delay the signals to the loudspeakers further from the stage or rostrum. The principles of generating delayed signals disclosed herein are useful in such an application.

I claim:

1. A signal processor which comprises:

(a) means for coupling a pair of analog input signals to the inputs of a corresponding pair of channels:

(b) means for converting analog signals coupled to the input of each of said channels into digital form; P1 (c) random access memory means for storing each of said digital signals at a different one of a plurality of addresses;

(d) means for retrieving said stored signals from said memory at said addresses after predetermined periods of time, said periods of time not being the same for all channels;

(e) means for generating said addresses for storing and retrieving said digitized signals in said memory which comprises:

(i) a stack in a loop circuit comprised of a counter and a plurality of registers, each of said registers being coupled to the next higher register in said stack, the highest register in said stack being coupled to said counter, said counter being coupled to the lowest register in said stack;

(ii) pulsing means for advancing said counter; and (iii) means for coupling a transfer pulse to each of said registers and said counter after said counter has advanced a predetermined number of counts, said transfer pulse causing said information in said stack and loop circuit to recirculate;

(f) means for converting said stored signals retrieved from said memory into analog amplitudes;

(g) means for coupling amplitudes proportional to said analog amplitudes derived from signals coupled to the input of each of said channels to the input of the corresponding channel; and (h) means for coupling amplitudes proportional to said analog amplitudes derived from signals coupled to the input of at least one of said channels to the input of the other of said channels.

2. A signal processor as recited in claim 1 wherein said means of converting analog signals into digital form comprises:

(a) means for sampling each of said signals to be converted at a predetermined rate;

(b) means for attenuating each of said samples to a level below a predetermined level;

(c) means for generating digital codes representative of the amounts of said attenuation; and (d) means for generating digital codes representative of the amplitudes of said attenuated signals;

and wherein said means for converting said stored signals retrieved from said memories into analog amplitudes comprises:

(a) means for converting the digital codes representative of said attenuated signal amplitudes read from said memory into signal amplitudes, and (b) means responsive to the digital codes representative of said amounts of attenuation read out of said memories for attenuating said signal amplitudes converted from digital codes whereby the amplitudes of said attenuated converted signals will be proportional to the amplitudes of the corresponding input signal samples.

3. A signal processor as recited in claim 2 wherein said means for generating digital codes representative of said attenuated signals comprises:

(a) a ramp voltage generator;

(b) a pulse generator for generating equally spaced pulses;

(c) a counter for counting the number of pulses generated by said pulse generator from a predetermined point on said ramp; and (d) comparator means for stopping said counter upon coincidence between said ramp voltage and said attenuated signal voltage, and wherein said means of converting said digital codes to signal amplitudes comprises:

(a) electronic switch means for coupling said ramp voltage to a capacitor;
(b) means for loading said digital codes to be converted into the counting register of a down counter, said counter counting the number of pulses generated by said pulse generator from the starting of said ramp; and
(c) means for opening said electronic switch when said down counter reaches a zero count.

4. A signal processor as recited in claims 2 or 3 wherein said means for generating digital codes representative of the amounts of attenuation and said means for attenuating said samples comprises:
(a) an attenuator having a plurality of taps for attenuating said sample;
(b) a reference signal source;
(c) a comparator for comparing said reference signal with said attenuated sample;
(d) means for generating digital codes in response to pulses;
(e) pulsing means;
(f) gating means for coupling pulses from said pulsing means to said digital code generating means so long as said attenuated sample is greater than said reference signal; and
(g) switching means responsive to said digital codes for sequentially selecting each of the taps of said attenuator starting with the tap of least attenuation.

5. A signal processor as recited in claims 1, 2, or 3 and further including means for coupling predetermined proportions of the input signals to at least one of said input channels to another of said plurality of input channels.

6. A signal processor as recited in claims 1, 2 or 3 and further including low pass and high pass filters in each of said input channels, for separating the signal components above and below predetermined crossover frequencies, signal components below the crossover frequency in each channel being converted into digital form, and signal components above said crossover frequency in the respective channel being mixed in predetermined ratios with said analog amplitudes derived from said respective channel.

7. A signal processor as recited in claims 1, 2 or 3 and further including:
(a) means for generating a sequence of memory storage addresses for storing said digital signals; and
(b) means for generating a plurality of sequences of memory reading addresses for reading said digitized data from said memory, each of said sequences of reading addresses being the same as a sequence of storage addresses generated at a predetermined previous time.

8. A signal processor as recited in claim 7 wherein said sequence of storage addresses is a sequence in numerical order and said sequences of reading addresses differ from said storage addresses by predetermined numbers.

9. Electronic apparatus as recited in claim 1 and further including clearing means for clearing a first of said registers in said stack and loop circuit when said counter reaches a predetermined count.

10. Electronic apparatus as recited in claim 9 wherein said means for clearing said first of said registers comprises:
(a) a down counter;
(b) means for presetting said down counter;
(c) means for pulsing said down counter at a rate dependent on said pulsing means; and
(d) means for clearing said first register when said down counter reaches zero count.

11. Electronic apparatus for generating simulated ambience signals which comprises:
(a) a pair of signal input circuits for coupling a stereophonic input signal to two channels;
(b) means for generating digital codes representative of the instantaneous values of signals coupled to each of said channels;
(c) random access memory means for storing each of said digital codes at a different one of a plurality of addresses;
(d) means for retrieving the digital codes stored in said memory at the addresses which correspond to the addresses of signal values from one of said channels entered into said memory at a first time prior to retrieval;
(e) means for retrieving the digital codes stored in said memory at the addresses which correspond to the addresses of signal values from the second of said channels entered into said memory at a second time prior to retrieval;
(f) means for generating said addresses for storing and retrieving said digital codes in said memory which comprises:
(i) a stack and loop circuit comprised of a counter and a plurality of registers, each of said registers being coupled to the next higher register in said stack, the highest register in said stack being coupled to said counter, said counter being coupled to the lowest register in said stack;
(ii) pulsing means for advancing said counter; and
(iii) means for coupling a transfer pulse to each of said registers and said counter after said counter has advanced a predetermined number of counts, said transfer pulse causing information in said stack and loop circuit to circulate.

12. Electronic apparatus as recited in claim 11 wherein said means of generating digital codes representative of signal values comprises:
(a) means for sampling said signals coupled to each of said channels at a predetermined rate;
(b) means for attenuating each of said samples to below a predetermined level;
(c) means for generating digital codes representative of the amounts of said attenuation; and
(d) means for generating digital codes representative the level of said attenuated sample;

and wherein said means for converting said digital codes into analog signals comprises:
(a) means for converting said digital codes representative of the level of said attenuated sample into signal amplitudes; and
(b) means for attenuating said converted signal amplitudes an amount dependent upon the digital codes read from said memory representative of the amount of said attenuation, whereby the amplitudes of said converted signals will be proportional to the corresponding signal samples.

13. Electronic apparatus as recited in claim 12 wherein said means for attenuating each of said samples and said means for generating digital codes representative of the amounts of said attenuation comprises:
(a) an attenuator having a plurality of taps for attenuating said samples;
(b) a reference signal source;

(c) a comparator for comparing said reference signal with said attenuated sample;
(d) means for generating digital codes in response to pulses;
(e) pulsing means;
(f) gating means for coupling pulses from said pulsing means to said digital code generating means so long as said attenuated sample is greater than said reference signal; and
(g) switching means responsive to said digital codes for sequentially selecting each of the taps of said attenuator starting with the tap of least attenuation.

14. Electronic apparatus as recited in claims 12 or 13 wherein said means for generating digital codes representative of said attenuated sample levels comprises:
(a) a ramp voltage generator;
(b) a pulse generator for generating equally spaced pulses;
(c) a counter for counting the number of pulses generated by said pulse generator from a predetermined point on said ramp; and
(d) comparator means for stopping said counter upon coincidence between said ramp voltage and said signal level;

and wherein said means of converting said digital codes representative of said attenuated sample levels to signal amplitudes comprises:
(a) electronic switch means for coupling said ramp voltage to a capacitor;
(b) means for loading said digital codes to be converted into the counting register of a down counter, said counter counting the number of pulses generated by said pulse generator from said predetermined point on said ramp; and
(c) means for opening said electronic switch when said down counter reaches a zero count.

15. A signal processor as recited in claims 11, 12, or 13 and further including means for coupling a predetermined portion of each channel of said sterophonic input signal to the opposite input channel.

16. A signal processor as recited in claims 11, 12, or 13 and further including low pass and high pass filters in each of said input channels, for separating the signal components above and below a predetermined crossover frequency signal components below said crossover frequency in each channel being converted into digital form, and signal components above said crossover frequency in the respective channel being mixed in predetermined ratios with said analog signals derived from said respective channel.

17. A signal processor as recited in claims 11, 12, or 13 and further including:
(a) means for generating a sequence of memory storage addresses for storing said digital codes; and
(b) means for generating a plurality of sequences of memory reading addresses for reading said digital codes from said memory, each of said sequences of reading addresses being the same as a sequence of storage addresses generated at a predetermined previous time.

18. A signal processor as recited in claim 17 wherein said sequence of storage addresses is a sequence in numerical order and said sequences of reading addresses differ from said storage addresses by predetermined numbers.

19. Electronic apparatus as recited in claim 11 and further including clearing means for clearing a first of said registers in said stack and loop circuit when said counter reaches a predetermined count.

20. Electronic apparatus as recited in claim 19 wherein said means for clearing said first of said registers comprises:
(a) a down counter;
(b) means for presetting said down counter;
(c) means for pulsing said down counter at a rate dependent on said pulsing means; and
(d) means for clearing said first register when said down counter reaches zero count.

21. Electronic apparatus as recited in claim 11, 12, or 13 where the ratio of said first previous time to said second previous time is between 0.55 and 0.75.

22. Electronic apparatus as recited in claim 21 where the ratio of said first previous time to said second previous time is 5 to 8.

23. Electronic apparatus as recited in claims 11, 12, or 13 and further including means for coupling a predetermined portion of the input signal coupled to the first of said input channels into the second input channel, and a predetermined portion of the input signal coupled to the second input channel into the first input channel.

24. Electronic apparatus for delaying signals which comprises:
(a) means for sampling input signals at a predetermined rate;
(b) means for attenuating each of said samples to a level below a predetermined level;
(c) means for generating digital codes representative of the amounts of said attenuation;
(d) means for generating digital codes representative of the amplitudes of said attenuated samples;
(e) random access memory means for storing each of said digital codes representative of the amounts of said attenuation and the amplitudes of said attenuated samples at a different one of a plurality of addresses;
(f) means for retrieving said digital codes representative of the amounts of said attenuation and the amplitudes of said attenuated samples from said addresses a predetermined time after said digital codes are stored in said memory;
(g) means for generating said addresses for storing and retrieving said digital codes in said memory which comprises:
(i) a stack and loop circuit comprised of a counter and a plurality of registers, each of said registers being coupled to the next higher register in said stack, the highest register in said stack being coupled to said counter, said counter being coupled to the lowest register in said stack;
(ii) pulsing means for advancing said counter; and
(iii) means for coupling a transfer pulse to each of said registers and said counter after said counter has advanced a predetermined number of counts, said transfer pulse causing information in said stack and loop circuit to circulate;
(h) means for converting the digital codes representative of said signal amplitudes retrieved from said memory into signal amplitudes; and
(i) means for altering the amplitudes of said converted signal amplitudes responsive to the digital codes retrieved which are representative of said amounts of attenuation whereby the amplitudes of said altered converted signals will be proportional to the amplitudes of the corresponding input signal samples.

25. Electronic apparatus as recited in claims 24 wherein said means for generating digital codes representative of said attenuated sample amplitudes comprises:

(a) a ramp voltage generator;

(b) a pulse generator for generating equally spaced pulses;

(c) a counter for counting the number of pulses generated by said pulse generator after the amplitude of said ramp reaches a predetermined value; and (d) comparator means for stopping said counter upon coincidence between said ramp voltage and said attenuated sample amplitude;

and wherein said means of converting said digital codes to signal amplitudes comprises;

(a) electronic switch means for coupling said ramp voltage to a capacitor;

(b) means for loading said digital codes to be converted into the counting register of a down counter, said counter counting the number of pulses generated by said pulse generator after the amplitude of said ramp reaches a predetermined value; and (c) means for opening said electronic switch when said down counter reaches a zero count.

26. Electronic apparatus as recited in claim 24 wherein both of said means for attenuating attenuate in steps, and said digital codes representative of the amount of attenuation are representative of the number of steps of attenuation.

* * * * *